US007925195B2

(12) United States Patent
Aruga et al.

(10) Patent No.: US 7,925,195 B2
(45) Date of Patent: Apr. 12, 2011

(54) METHOD OF MANUFACTURING TONER CARRIER ROLLER, DEVELOPER APPARATUS, AND IMAGE FORMING APPARATUS

(75) Inventors: Tomohiro Aruga, Matsumoto (JP); Masahiro Maeda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 191 days.

(21) Appl. No.: 12/354,600

(22) Filed: Jan. 15, 2009

(65) Prior Publication Data

US 2009/0185838 A1 Jul. 23, 2009

(30) Foreign Application Priority Data

Jan. 23, 2008 (JP) ..... 2008-012148

(51) Int. Cl.
*G03G 15/08* (2006.01)

(52) U.S. Cl. ..... 399/286

(58) Field of Classification Search ..... 399/286, 399/276

See application file for complete search history.

(56) References Cited

U.S. PATENT DOCUMENTS

| | | | | |
|---|---|---|---|---|
| 3,836,054 | A * | 9/1974 | Schon | 222/414 |
| 2007/0104516 | A1 | 5/2007 | Katoh et al. | |
| 2007/0110481 | A1 | 5/2007 | Yamada et al. | |
| 2007/0212088 | A1 | 9/2007 | Koike et al. | |

FOREIGN PATENT DOCUMENTS

| | | | |
|---|---|---|---|
| JP | 2003-057940 | | 2/2003 |
| JP | 2003330262 | A | 11/2003 |
| JP | 2007-121948 | | 5/2007 |
| JP | 2007-127800 | | 5/2007 |
| JP | 2007-140080 | | 6/2007 |
| JP | 2007-148195 | | 6/2007 |
| JP | 2007199423 | A | 8/2007 |
| JP | 2007199424 | A | 8/2007 |

OTHER PUBLICATIONS

European search report for corresponding European application 09151092.5 lists the references above.

* cited by examiner

*Primary Examiner* — Constantine Hannaher
(74) *Attorney, Agent, or Firm* — DLA Piper LLP (US)

(57) ABSTRACT

A method of manufacturing a toner carrier roller that is shaped like a cylinder on an outer circumferential surface of which concave and convex sections for carrying toner are provided, includes: preparing a roller base member which is shaped like a cylinder; forming helix-like first grooves on the outer circumferential surface of the roller base member; and forming helix-like second grooves, which cross the first grooves, on the outer circumferential surface of the roller base member, wherein a pitch ratio of the first grooves and the second grooves is a non-integer ratio.

8 Claims, 14 Drawing Sheets

FIG. 14

| COMMON CONDITIONS | DIAMETER OF DEVELOPING ROLLER 2R=18mm<br>AVERAGE TONER PARTICLE DIAMETER Dave=5μm | | | |
|---|---|---|---|---|
| | NUMERICAL VALUE EXAMPLE 1 | NUMERICAL VALUE EXAMPLE 2 | NUMERICAL VALUE EXAMPLE 3 | NUMERICAL VALUE EXAMPLE 4 |
| HELIX ANGLE α [DEGREE] | 45 | 45 | 45 | 45 |
| ARRANGEMENT PITCH A [μm] | 80 | 142 | 160 | 80 |
| HELIX ANGLE β [DEGREE] | 135 | 135 | 135 | 135 |
| ARRANGEMENT PITCH B [μm] | 79 | 141 | 159 | 70 |
| L1 [μm] | 112.4 | 200.1 | 225.6 | 106.1 |
| L2 [μm] | 111.4 | 198.8 | 224.2 | 9837 |
| L3 [μm] | 0.7 | 0.7 | 0.7 | 7.1 |
| (2πR/L1)·L3 [μm] | 355.7 | 199.8 | 177.3 | 3769.9 |
| CHARACTERISTICS REGARDING SHAPE | L3<Dave<br>(2πR/L1)·L3>L2 | L3<Dave<br>(2πR/L1)·L3≒L2 | L3<Dave<br>(2πR/L1)·L3<L2 | L3>Dave<br>(2πR/L1)·L3>L2 |
| FILMING TO SEAL MEMBER | ○ | ◎ | × | × |
| FILMING TO DEVELOPING ROLLER | ○ | ◎ | × | × |
| IMAGE STRIPE | ○ | ◎ | × | × |
| HISTORY OF DEVELOPMENT | ○ | ◎ | × | × |
| FOGGING | ○ | ◎ | × | × |
| SCATTERING OF TONER | ○ | ◎ | × | × |

METHOD OF MANUFACTURING TONER CARRIER ROLLER, DEVELOPER APPARATUS, AND IMAGE FORMING APPARATUS

CROSS REFERENCE TO RELATED APPLICATION

The disclosure of Japanese Patent Application No. 2008-12148 filed on Jan. 23, 2008 including specification, drawings and claims is incorporated herein by reference in its entirety.

BACKGROUND

1. Technical Field

The invention relates to a method of manufacturing a toner carrier roller whose surface includes concaves and convexes which are regularly formed, a developer apparatus and an image forming apparatus which use the toner carrier roller.

2. Related Art

In techniques for developing an electrostatic latent image carried on an image carrier with toner, an apparatus is widely used which includes a toner carrier roller which is shaped approximately like a cylinder, carries toner on a surface thereof, and is arranged opposed facing the image carrier. For the purpose of improving the characteristics of toner carried on the surface of such a toner carrier roller, the applicant of the present application has earlier disclosed a stricture of a toner carrier roller having a cylindrical shape that the surface of the roller includes convex sections which are regularly arranged and a concave section which surrounds the convex sections (JP-A-2007-121948). Since the concavo-convex patterns in the surface are regulated and uniform, such a structure is advantageous in that it permits easy control of the thickness of a toner layer which is carried on the surface of the roller, the charge level and the like.

In an image forming apparatus constructed as described above, a seal which comes into contact with a developing roller surface is provided in a clearance between a developing roller as a toner carrier roller and a developer housing to prevent the leakage of toner.

SUMMARY

In the above related art, the seal is brought into contact in a rotation direction of the developing roller, that is, a so-called trail direction to prevent the toner on the developing roller surface from being scraped off. However, since the seal member is pressed into contact with the developing roller having the toner adhering to the surface thereof it is unavoidable that the toner adheres to the surface of the seal member. Such adhesion of the toner to the seal member could become a cause of toner leakage resulting from a seal defect or filming resulting from the adhesion of the fixed toner to the developing roller surface.

Particularly in the case of providing the regular convexo-concave pattern on the toner carrier roller as in the above related art, the toner adhesion to the seal member also appears with regularity. Thus, it is thought that toner leakage, filming or the like is likely to be induced by such local toner adhesion.

An advantage of some aspects of the invention is to provide technology capable of preventing problems such as toner leakage and filming resulting from toner adhesion to a seal member in an method of manufacturing a toner carrier roller having a regular convexo-concave pattern on a surface thereof, a developer apparatus and an image forming apparatus using which use the toner carrier roller.

According to a first aspect of the invention, there is provided a method of manufacturing a toner carrier roller that is shaped like a cylinder on an outer circumferential surface of which concave and convex sections for carrying toner are provided, comprising: preparing a roller base member which is shaped like a cylinder; forming helix-like first grooves on the outer circumferential surface of the roller base member; and forming helix-like second grooves, which cross the first grooves, on the outer circumferential surface of the roller base member, wherein a pitch ratio of the first grooves and the second grooves is a non-integer ratio.

According to a second aspect of the invention, there is provided a method of manufacturing a toner carrier roller that is shaped like a cylinder on an outer circumferential surface of which concave and convex sections for carrying toner are provided, comprising: preparing a roller base member which is shaped like a cylinder; forming helix-like first grooves on the outer circumferential surface of the roller base member; and forming helix-like second grooves, which cross the first grooves, on the outer circumferential surface of the roller base member, wherein a helix angle of the first grooves and a helix angle of the second grooves are different from each other.

According to these aspects of the invention, it is possible to provide a toner carrier roller which is capable of suppressing toner from adhering to the seal member. The reason is as described below.

As the first and the second grooves are formed which are shaped like mutually crossing helixes on the outer circumferential surface of the roller base member, a concave section is formed on the outer circumferential surface of the roller base member like a lattice of twill lines. As a result, surrounded by the lattice-like concave section, a number of convex sections each approximately shaped like a parallelogram are formed on the outer circumferential surface of the toner carrier roller. Since the helix angles of the first and the second grooves are not the same or since the pitch ratio of these helixes is a non-integer ratio, the positions of the convex sections which are aligned in the circumferential direction of the outer circumferential surface of the toner carrier roller are slightly shifted from each other in an axial direction which is parallel to the center of axle of the toner carrier roller.

In the toner carrier roller manufactured in this fashion, the convex sections exhibit a function of scraping off toner adhering to the seal member, and among the apexes of the parallelogram of each convex section, at the front-most apex in a moving direction of the surface of the toner carrier roller as the roller rotates, the toner scraping effect is the greatest. As the toner carrier roller rotates while abutting on the seal member, the positions of the apexes of the parallelograms abutting on the seal member move gradually in the direction of the rotational axis of the toner carrier roller in accordance with rotation. The apexes of the parallelograms scrape toner off uniformly in the axial direction, thereby eliminating local adhesion of toner.

Where the toner carrier roller manufacturing method according to this aspect of the invention is used, it is therefore possible to manufacture a toner carrier roller which suppresses adhesion of toner to the seal member and prevents a problem such as toner leakage and filming attributable to adhesion of toner to the seal member. In the manufacturing method, the first and the second grooves may each be a multi-thread groove.

According to a third aspect of the invention, there is provided a developer apparatus, comprising: a housing that stores toner inside; a toner carrier roller that is shaped approximately like a cylinder, is mounted to the housing rotatably about a rotational axis, rotates while carrying toner on a surface thereof to convey the toner to outside the housing, and is provided, on the surface thereof, with a plurality of convex sections which are regularly arranged and a concave section which surrounds the convex sections, the convex sections including top surfaces that coincide with a part of a cylindrical surface of a single cylinder; and a seal member that is arranged in abutting contact with the surface of the toner carrier roller moving from the outside the housing toward the inside the housing to prevent toner leakage from the inside the housing, wherein out of surrounding area of the top surface of each of the convex sections, a portion located at front-most in a moving direction associated with rotation of the toner carrier roller is a leading portion of the convex section, and a maximum value of gaps in an axial direction, which is parallel to the rotational axis of the toner carrier roller, between the trajectories which the leading portions of the convex sections follow while the toner carrier roller rotates one round is smaller than a volume average particle diameter of the toner.

In this structure according to this aspect of the invention, the leading portions of the respective convex sections scrape off toner on the seal member, and toner adhering to the surface of the seal member located on the trajectories of the leading portions gets scraped off due to this function. Since toner in an area not included in the trajectory of any leading portion within the surface of the toner carrier roller is not exposed to scraping, it is ideal that such an area is reduced as much as possible. According to the invention, the gaps between the trajectories are, even when the largest, smaller than a volume average particle diameter of the toner. Hence, it is possible to scrape off from the surface of the toner carrier roller without fail such toner whose particle diameters are equal to or larger than at least an average particle diameter. That is, it is possible according to this aspect of the invention to suppress adhesion of toner to the seal member and prevent a problem such as toner leakage and filming attributable to adhesion of toner to the seal member.

According to a fourth aspect of the invention, there is provided a developer apparatus, comprising: a housing that stores toner inside; a toner carrier roller that is shaped approximately like a cylinder, is mounted to the housing rotatably about a rotational axis, rotates while carrying toner on a surface thereof to convey the toner to outside the housing, and is provided, on the surface thereof, with a plurality of convex sections which are regularly arranged and a concave section which surrounds the convex sections, the convex sections including top surfaces that coincide with a part of a cylindrical surface of a single cylinder and have apexes which project most toward the front side in a moving direction of the surface of the toner carrier roller; and a seal member that is arranged in abutting contact with the surface of the toner carrier roller moving from the outside the housing toward the inside the housing to prevent toner leakage from the inside the housing, wherein each line that connects the apexes of two convex sections among adjacent convex sections whose positions are least different from each other in an axial direction, which is parallel to the rotational axis of the toner carrier roller, over a shortest distance along the cylindrical surface, partially forms a single helix on the cylindrical surface.

In this structure according to this aspect of the invention, the apexes of all convex sections in the surface of the toner carrier roller are located on the same helix on the cylindrical surface. Hence, the positions of the apexes of the convex sections abutting on the seal member shift by a very small distance as the toner carrier roller rotates, and return back again to their initial abutting positions when the toner carrier roller has just rotated once. In this manner, it is possible to minimize differences between the axial-direction positions of apexes which are adjacent to each other in the moving direction of the surface of the toner carrier roller, and hence, ensure a uniform effect of scraping off toner which is on the seal member in the entire axial-direction region. It is thus possible to scrape off without fail particles having small particle diameters as well while securing a uniform scraping effect in the axial direction. For this reason, it is possible according to this aspect of the invention to suppress adhesion of toner to the seal member and prevent a problem such as toner leakage and filming attributable to adhesion of toner to the seal member.

According to a fifth aspect of the invention, there is provided an image forming apparatus, comprising: a latent image carrier that carries an electrostatic latent image; a housing that stores toner inside; a toner carrier roller that is shaped approximately like a cylinder, is mounted to the housing rotatably about a rotational axis, rotates while carrying toner on a surface thereof to convey the toner to an opposed position facing the latent image carrier, and is provided, on the surface thereof, with a plurality of convex sections which are regularly arranged and a concave section which surrounds the convex sections, the convex sections including top surfaces that coincide with a part of a cylindrical surface of a single cylinder; and a seal member that is arranged in abutting contact with the surface of the toner carrier roller moving from the outside the housing toward the inside the housing to prevent toner leakage from the inside the housing, wherein out of surrounding area of the top surface of each of the convex sections, a portion located at front-most in a moving direction associated with rotation of the toner carrier roller is a leading portion of the convex section, and a maximum value of gaps in an axial direction, which is parallel to the rotational axis of the toner carrier roller, between the trajectories which the leading portions of the convex sections follow while the toner carrier roller rotates one round is smaller than a volume average particle diameter of the toner.

Using this structure according to this aspect of the invention, just like the developer apparatus described above, it is possible to suppress adhesion of toner to the seal member and prevent a problem such as toner leakage and filming attributable to adhesion of toner to the seal member.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 14 is a table for describing the effect of the invention.

DESCRIPTION OF EXEMPLARY EMBODIMENTS

Figure 1:
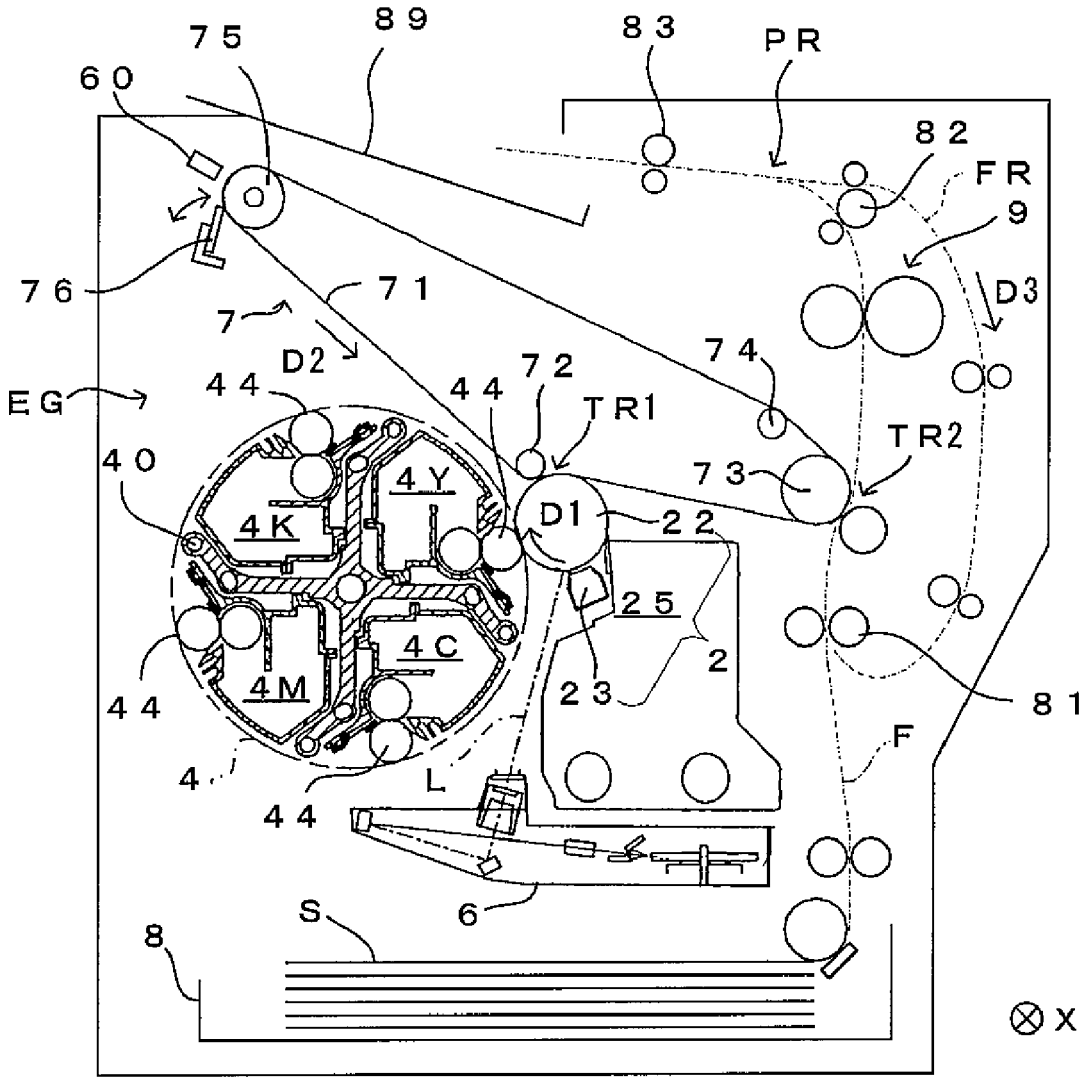
FIG. 1 is a diagram showing an embodiment of an image forming apparatus according to the invention.
Figure 2:
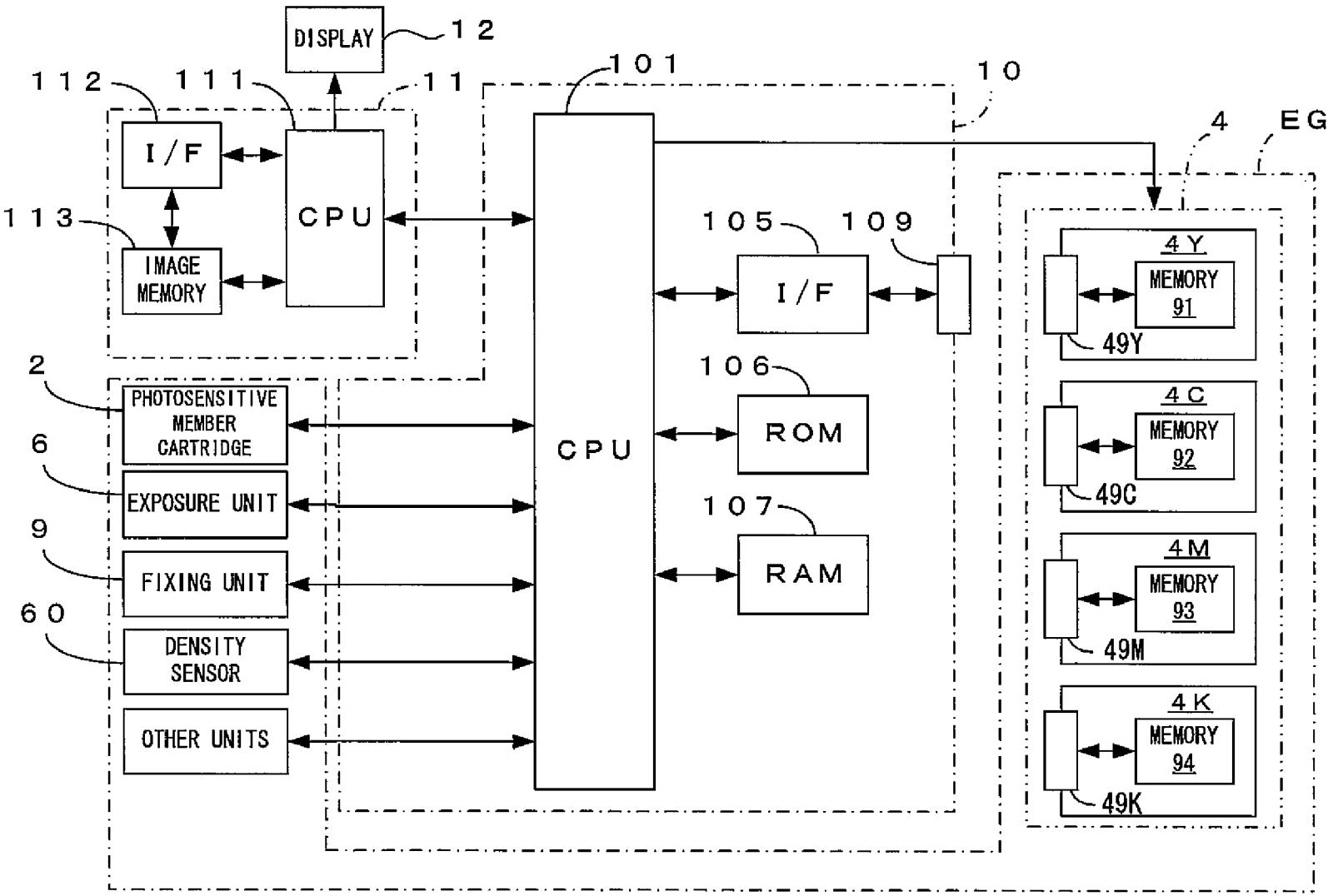
FIG. 2 is a block diagram of an electric structure of the image forming apparatus which is shown in FIG. 1.

FIG. 1 is a diagram showing an embodiment of an image forming apparatus according to the invention. FIG. 2 is a block diagram of an electric structure of the image forming apparatus which is shown in FIG. 1. This apparatus is an image forming apparatus which overlays toner in four colors of yellow (Y), cyan (C), magenta (M) and black (K) one atop the other and accordingly forms a full-color image, or forms a monochromatic image using only black toner (K). In the image forming apparatus, when an image signal is fed to a main controller 11 from an external apparatus such as a host computer, a CPU 101 provided in an engine controller 10 controls respective portions of an engine part EG in accordance with an instruction received from the main controller 11 to perform a predetermined image forming operation, and accordingly, an image which corresponds to the image signal is formed on a sheet S.

In the engine part EG, a photosensitive member 22 is disposed so that the photosensitive member 22 can freely rotate in an arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a waste toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from an apparatus main body as one integrated unit.

An exposure unit 6 emits a light beam L toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The developer unit 4 develops thus formed electrostatic latent image with toner. Specifically, the developer unit 4 includes a support frame 40 which is provided rotatable about a rotation shaft orthogonal to a plane of FIG. 1 and a yellow developer 4Y, a cyan developer 4C, a magenta developer 4M and a black developer 4K which are freely attachable to and detachable from the support frame 40 as cartridges and house toner of the respective colors. An engine controller 10 controls the developer unit 4. The developer unit 4 is driven into rotation based on a control instruction from the engine controller 10. When the developers 4Y, 4C, 4M and 4K are selectively positioned at a predetermined developing position which is faced with the photosensitive member 22 over a predetermined gap, the developing roller 44 which is disposed in this developer and carries a toner of a selected color is positioned facing the photosensitive member 22, and the developing roller 44 supplies the toner onto the surface of the photosensitive member 22 at the facing position. In this way, the electrostatic latent image on the photosensitive member 22 is visualized with the toner of the selected color.

Figure 3:
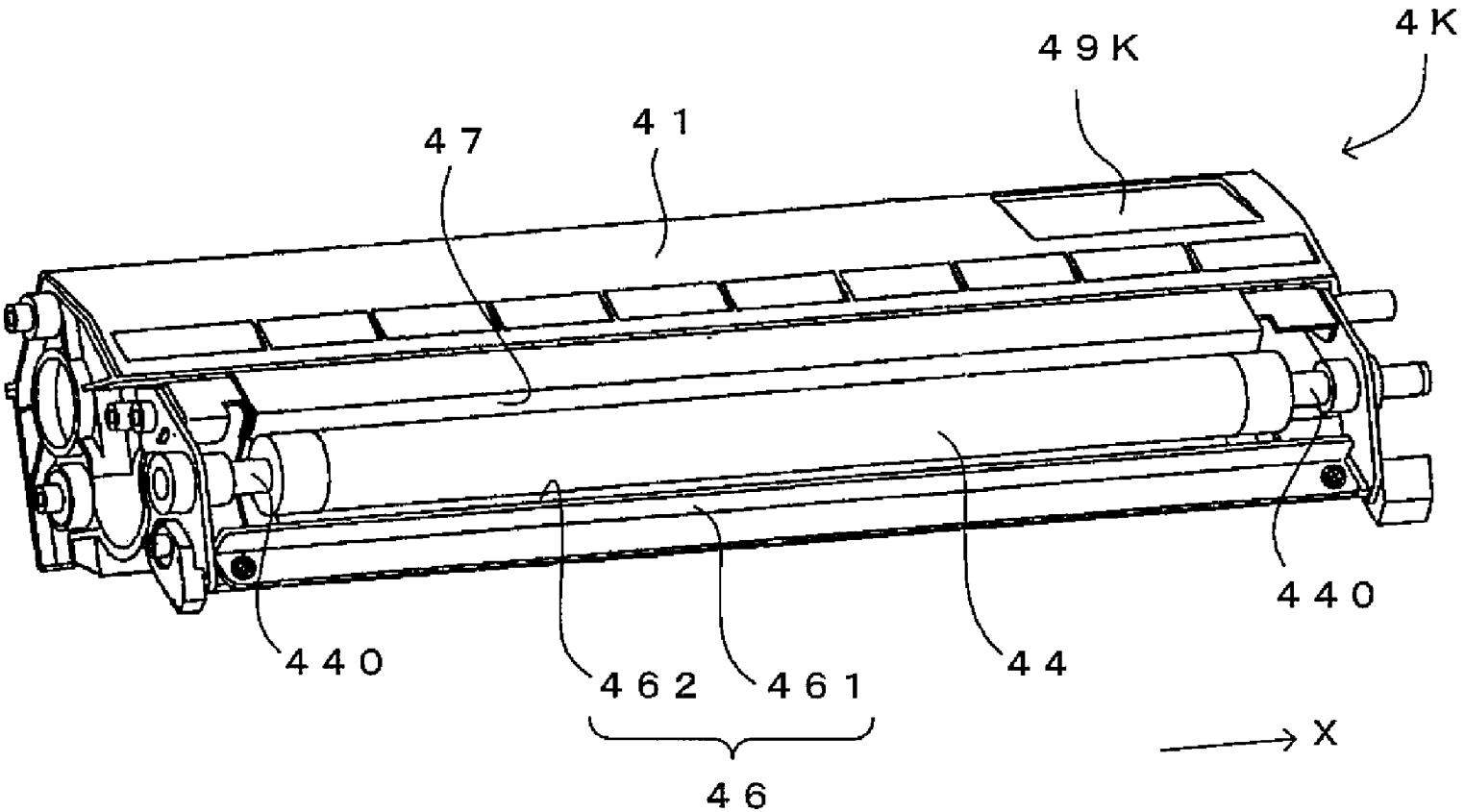
FIG. 3 is a diagram showing the appearance of the developer.
Figure 4A:
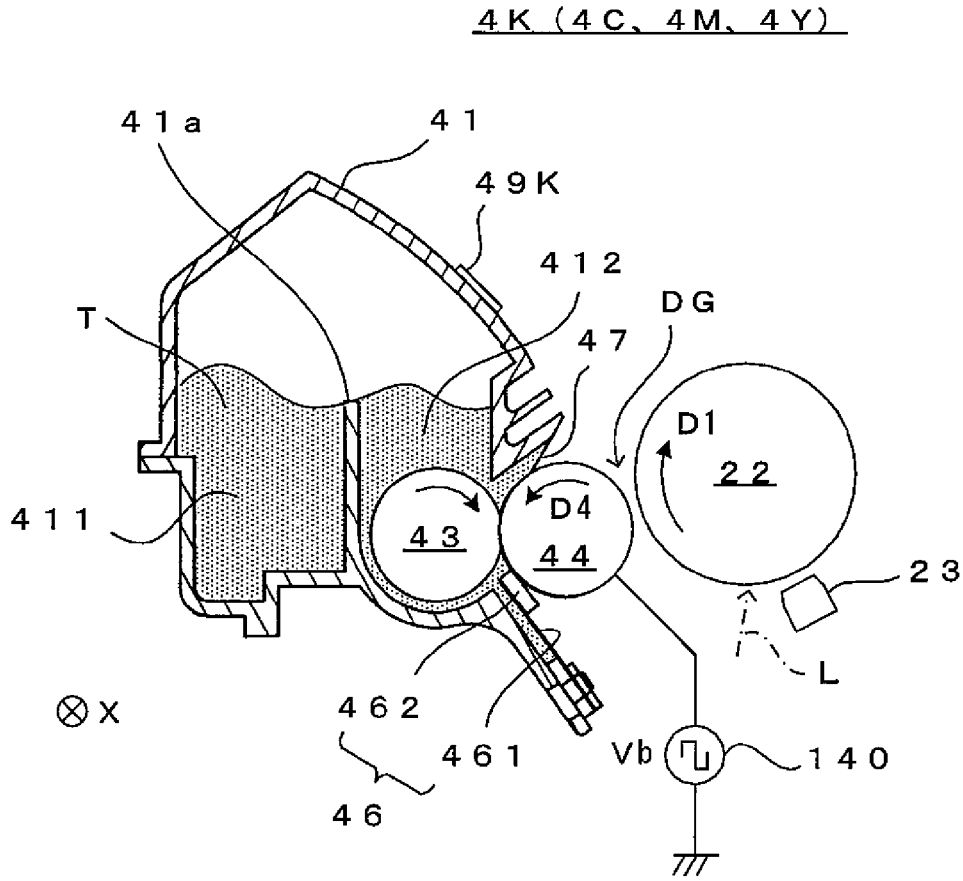
FIG. 4A is a cross sectional view showing a structure of the developer.
Figure 4B:
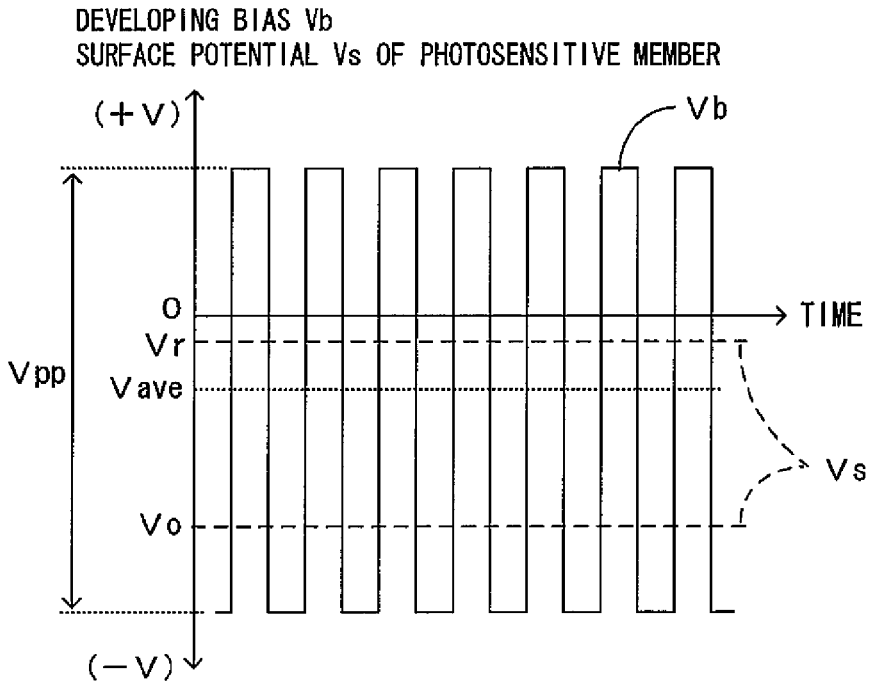
FIG. 4B is a graph showing the relationship between a waveform of a developing bias and a surface potential of the photosensitive member.

FIG. 3 is a diagram showing the appearance of the developer. FIG. 4A is a cross sectional view showing a structure of the developer, and FIG. 4B is a graph showing the relationship between a waveform of a developing bias and a surface potential of the photosensitive member. The developers 4Y, 4C, 4M and 4K have identical structures. Therefore, the structure of the developer 4K will now be described in further detail with reference to FIGS. 3 and 4A. The other developers 4Y, 4C and 4M have the same structures and functions, to be noted.

In the developer 4K, a feed roller 43 and a developing roller 44 are rotatably attached with a shaft to a housing 41 which houses monocomponent toner T inside. When the developer 4K is positioned at the developing position described above, the developing roller 44 is positioned at a facing position which is faced with the photosensitive member 22 over a developing gap DG, and these rollers 43 and 44 are engaged with a rotation driver (not shown) which is provided in the main body to rotate in a predetermined direction. The feed roller 43 is shaped like a cylinder and is made of an elastic material such as foamed urethane rubber and silicone rubber. The developing roller 44 is shaped like a cylinder and is made of metal or alloy such as copper, aluminum and stainless steel. The two rollers 43 and 44 rotate while staying in contact with each other, and accordingly, the toner is rubbed against the surface of the developing roller 44 and a toner layer having a predetermined thickness is formed on the surface of the developing roller 44. Although negatively-charged toner is used in this embodiment, positively-charged toner may be used instead.

The space inside the housing 41 is divided by a partition wall 41*a* into a first chamber 411 and a second chamber 412. The feed roller 43 and the developing roller 44 are both provided in the second chamber 412. With a rotation of these rollers, toner within the second chamber 412 flows and is fed to the surface of the developing roller 44 while getting agitated. Meanwhile toner stored inside the first chamber 411 would not be moved by the rotation since it is isolated from the feed roller 43 and the developing roller 44. This toner is mixed with toner stored in the second chamber 412 and is agitated by the rotation of the developer unit 4 while holding the developer.

As described above, in this developer, the inside of the housing is separated into the two chambers, and the side walls of the housing 41 and the partition wall 41*a* surround the feed roller 43 and the developing roller 44, and accordingly, the second chamber 412 of relatively small volume is provided. Therefore, even when a remaining toner amount is small, toner is supplied efficiently to near the developing roller 44. Further, supply of toner from the first chamber 411 to the second chamber 412 and agitation of the whole toner are performed by the rotation of the developer unit 4. Hence, an auger-less structure is realized that an agitator member (auger) for agitating toner is not provided inside the developer.

Further, in the developer 4K, a restriction blade 46 is disposed which restricts the thickness of the toner layer formed on the surface of the developing roller 44 into the predetermined thickness. The restriction blade 46 includes a plate-like member 461 made of elastic material such as stainless steel, phosphor bronze or the like and an elastic member 462 which is attached to a front edge of the plate-like member 461 and is made of a resin member such as silicone rubber and a urethane rubber. A rear edge of the plate-like member 461 is fixed to the housing 41. The elastic member 462 attached to the front edge of the plate-like member 461 is positioned on the upstream side to the rear edge of the plate-like member 461 in a rotation direction D4 of the developing roller 44 shown by an arrow in FIG. 4A. The elastic member 462 elastically abuts on the surface of the developing roller 44 to form a restriction nip, thereby restricting the toner layer formed on the surface of the developing roller 44 finally into the predetermined thickness.

The toner layers thus formed on the surface of the developing roller 44 are transported, by means of the rotation of the developing roller 44, one after another to the opposed position against the photosensitive member 22 on the surface of which an electrostatic latent image is formed. The developing bias from a bias power source 140 controlled by the engine controller 10 is applied to the developing roller 44. As shown in FIG. 4B, a surface potential Vs of the photosensitive member 22 drops down approximately to a residual potential Vr at exposed segments exposed by the light beam L from the exposure unit 6 after getting uniformly charged by the charger unit 23, but stays at an almost uniform potential Vo at non-exposed segments not exposed by the light beam L. Meanwhile, the developing bias Vb applied to the developing roller 44 is rectangular-wave AC voltage on which a DC potential Vave is superimposed, and its peak-to-peak voltage will be hereinafter denoted at Vpp. With application of such a developing bias Vb, toner carried on the developing roller 44 is made jump across a developing gap DG and partially adheres to the respective sections in the surface of the photosensitive member 22 in accordance with the surface potential Vs of the photosensitive member 22, whereby an electrostatic latent image on the photosensitive member 22 is visualized as a toner image in the color of the toner.

A rectangular-wave voltage having a peak-to-peak voltage of 1500V and a frequency of about 3 kHz, for example, may be used as the developing bias voltage Vb. Since an electric potential difference between the direct current component Vave of the developing bias voltage Vb and a residual potential Vr of the photosensitive member 22 constitutes a so-called development contrast which affects image density, the direct current component Vave may be set to a required value for obtaining a predetermined image density.

The housing 41 further includes a seal member 47 which is pressed against the surface of the developing roller 44 on the downstream side to the opposed position facing the photosensitive member 22 in the rotation direction of the developing roller 44. The seal member 47 is a belt-like film made of a flexible material such as polyethylene, nylon or fluororesin extending in an axial direction X parallel to a rotational axis of the developing roller 44. One end of the seal member 47 in a direction perpendicular to the axial direction X is fixed to the housing 41, and the other end of the seal member 47 abuts on the surface of the developing roller 44. The other end of the seal member 47 is allowed to abut on the developing roller 44 as directed toward the downstream side in the rotation direction D4 of the developing roller 44, or directed in a so-called trail direction. The other end of the seal member 47 guides toner which remains on the surface of the developing roller 44 after moving past the opposed position facing the photosensitive member 22 to inside the housing 41 and prevents toner inside the housing from leaking to outside.

Figure 5:
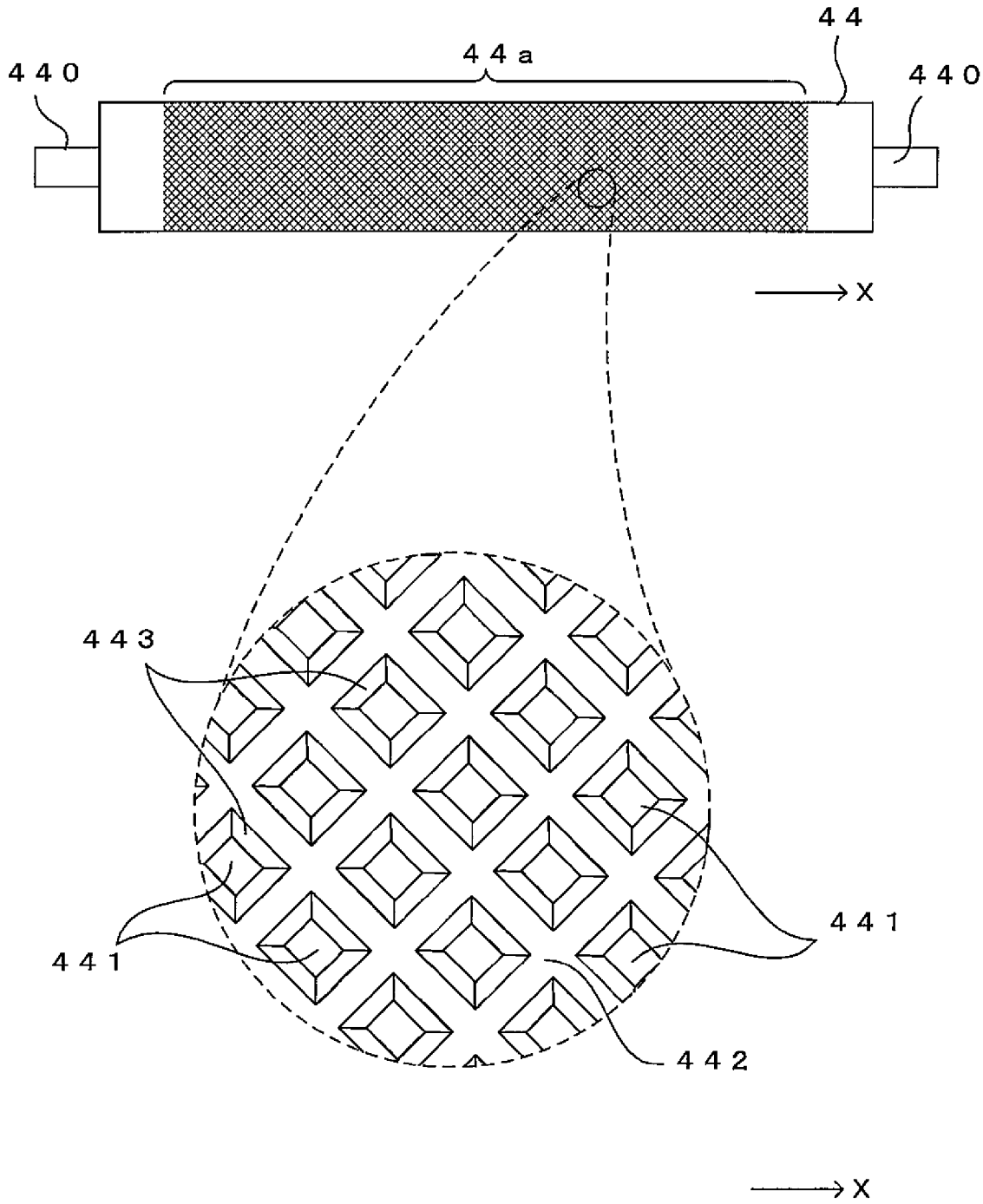
FIG. 5 is a group of diagrams showing a side view of the developing roller and a partially expanded view of the surface of the developing roller.

FIG. 5 is a group of diagrams showing a side view of the developing roller and a partially expanded view of the surface of the developing roller. The developing roller 44 is shaped like an approximately cylindrical roller. A shaft 440 is provided at the both ends of the roller in the longitudinal direction of the roller such that the shaft is coaxial with the roller. With the shaft 440 supported by the developer main body, the entire developing roller 44 is freely rotatable. A central area 44*a* in the surface of the developing roller 44, as shown in the partially expanded view in FIG. 5 (inside the dotted-line circle), is provided with a plurality of convex sections 441 which are regularly arranged and a concave section 442 which surrounds the convex sections 441.

Each one of the convex sections 441 projects forward from the plane of FIG. 5, and a top surface of each convex section 441 forms a part of a single cylindrical surface which is coaxial with the rotational axis of the developing roller 44. This virtual cylindrical surface is hereinafter called "enveloping cylindrical surface" of the developing roller 44. The concave section 442 is a continuous groove which surrounds the convex sections 441 like a net. The entire concave section 442 also forms a single cylindrical surface which is different from the cylindrical surface which is made by the convex sections and is coaxial with the rotational axis of the developing roller 44. Moderate slopes 443 connect the convex sections 441 to the concave section 442 which surrounds the convex sections 441. Specifically, a normal line to each slope 443 contains a component which is outward in a radial direction of the developing roller 44 (upward in FIG. 5), that is, a component in a direction away from the rotational axis of the developing roller 44.

Figure 6:
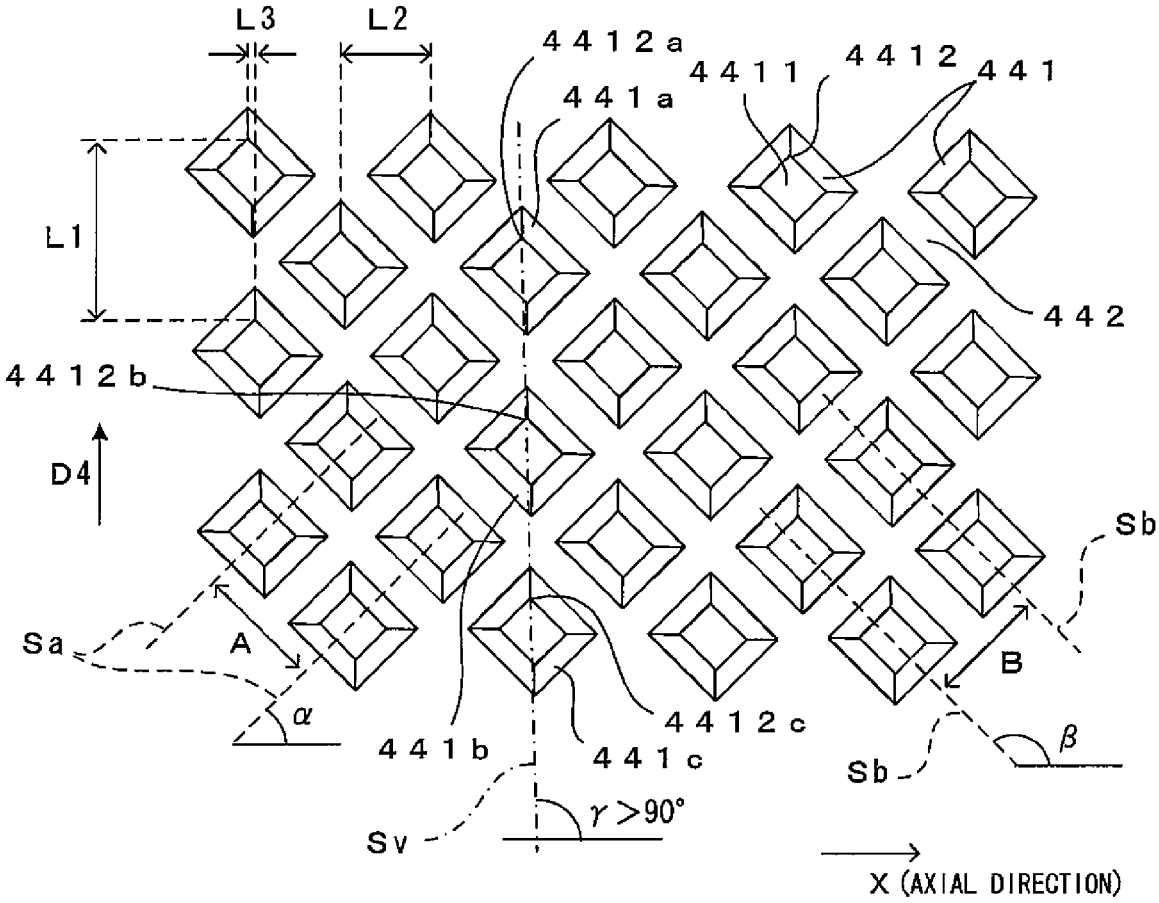
FIG. 6 is a view showing the structure of the surface of the developing roller in more detail.

FIG. 6 is a view showing the structure of the surface of the developing roller in more detail. To be more particular, FIG. 6 is a development plan view of the surface of the developing roller 44 which forms an approximately cylindrical surface. As described above, there are a number of convex sections 441 in the surface of the developing roller 44. Each convex section 441 is surrounded by the concave section 442 which is formed like a tilted lattice in an oblique direction in FIG. 6, and the convex sections 441 are equidistant from each other along lines Sa and Sb which respectively have tilt angles $\alpha$ and $\beta$ with respect to the axial direction X of the developing roller 44. The two tilt angles $\alpha$ and $\beta$ are 45 degrees and 135 degrees respectively, the pitch A of the lines Sa and the pitch B of the lines Sb have slightly different values from each other in this embodiment. The relationship A>B holds true here. As a result, top surfaces 4411 of the respective convex sections 441 are therefore shaped approximately like asymmetric parallelograms instead of rhombuses which are symmetric in the axial direction X and in the moving direction D4.

A line between a leading-side apex 4412 of the top surface 4411 of one convex section 441 located on the front side in the moving direction in accordance with rotation of the developing roller 44 and a leading-side apex of the top surface of one of the neighboring convex sections whose position is least different in the axial direction X is at an angle which is somewhat shifted from 90 degrees with respect to the axial direction X. Taking a convex section 441*a* shown in FIG. 6 as an example, one of the neighboring convex sections whose position is least different in the axial direction X is a convex section 441*b* which is roughly below the convex section 441*a*

(that is, behind the convex section 441*a* in the moving direction D4) in FIG. 6. The convex section 441*b* is not immediately below the convex section 441*a* in FIG. 6 but is at a position which is slightly shifted toward the right-hand side.

Hence, a line Sv between leading-side apexes 4412*a*, 4412*b* of top surfaces of the convex sections 441*a*, 441*b* is a line which slants toward the right-hand side in FIG. 6, and its angle γ with respect to the direction X is slightly larger than 90 degrees. A leading-side apex 4412*c* of the convex section 441*c* which is approximately below the convex section 441*b* is also on the line Sv. This relationship holds true as for the respective convex sections 441 on the surface of the developing roller 44.

As for the arrangement of the convex sections 441 on the surface of the developing roller 44, in one sense, the convex sections 441 are provided at equal intervals along the line Sv. The columns of the convex sections 441 along the line Sv will be hereinafter referred to as "the convex section columns". Although the line Sv is a straight line in FIG. 6 since FIG. 6 shows the surface of the developing roller 44 in a development plan view, the line is a curved line following the enveloping cylindrical surface of the developing roller 44 in reality.

For the convenience of description below, the definitions of the reference symbols will now be provided. The symbol L1 denotes a distance in the moving direction D4 of the surface of the developing roller 44 between leading-side apexes of one convex section and one of the surrounding convex sections whose position in the axial direction X is least different from the convex section. The value L1 expresses the pitch of adjacent convex sections on the convex section columns. The "distance" herein referred to is a distance along the enveloping cylindrical surface which the surface of the developing roller 44 forms, and this is applicable to the following definitions as well. The symbol L3 denotes a distance between these two leading-side apexes in the axial direction X. The value L3 expresses how much the positions of two adjacent convex sections on the convex section columns are deviated from each other. The symbol L2 denotes a difference in position in the axial direction X between the leading-side apexes of one convex section and one of the surrounding convex sections whose position in the direction D4 is least different from the convex section. The value L2 expresses the pitch of the convex section columns which are adjacent to each other.

Referring back to FIG. 1, the description of the image forming apparatus is continued. The toner image developed by the developer unit 4 as described above is primarily transferred onto an intermediate transfer belt 71 of a transfer unit 7 in a primary transfer region TR1. The transfer unit 7 includes the intermediate transfer belt 71 mounted on a plurality of rollers 72 to 75 and a driver (not shown) for driving the roller 73 into rotation to rotate the intermediate transfer belt 71 in a specified rotating direction D2. In the case of transferring a color image onto the sheet S, the toner images of the respective colors formed on the photosensitive member 22 are superimposed on the intermediate transfer belt 71 to form the color image, which is secondarily transferred onto the sheet S dispensed one by one from a cassette 8 and conveyed to a secondary transfer region TR2 along a conveyance path F.

At this time, for the purpose of correctly transferring the image on the intermediate transfer belt 71 onto the sheet S at a predetermined position, the timing of feeding the sheet S into the secondary transfer region TR2 is controlled. To be more specific, there is a gate roller 81 disposed in front of the secondary transfer region TR2 on the transportation path F. The gate roller 81 starts to rotate in accordance with the timing of rotation of the intermediate transfer belt 71, and accordingly, the sheet S is fed into the secondary transfer region TR2 at a predetermined timing.

Further, the sheet S on which the color image is thus formed is transported to a discharge tray 89 which is disposed at a top surface of the apparatus main body via a pre-discharge roller 82 and a discharge roller 83 after the toner image is fixed to the sheet S by a fixing unit 9. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. The sheet S is returned back to the transportation path F again before arriving at the gate roller 81. At this time, the surface of the sheet S which abuts on the intermediate transfer belt 71 in the secondary transfer region TR2 and is to receive a transferred image is opposite to the surface which already carries the image. In this fashion, it is possible to form images on the both surfaces of the sheet S.

Further, as shown in FIG. 2, the respective developers 4Y, 4C, 4M and 4K comprise memories 91, 92, 93 and 94 respectively which store data related to the production lot, the use history, the remaining toner amount and the like of the developers. In addition, wireless telecommunication devices 49Y, 49C, 49M and 49K are provided in the developers 4Y, 4C, 4M and 4K, respectively. When necessary, the telecommunication devices selectively perform non-contact data telecommunication with a wireless telecommunication device 109 which is provided in the apparatus main body, whereby data transmission between the CPU 101 and the memories 91 through 94 via the interface 105 is performed to manage various types of information regarding the developers such as management of consumables. Meanwhile, in this image forming apparatus, non-contact data transmission using electro-magnetic scheme such as wireless telecommunication is performed. However, the apparatus main body and each developer may be provided with connectors and the like, and the connectors may be engaged mechanically to perform data transmission between each other.

Further, as shown in FIG. 2, the apparatus includes a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, and the like in accordance with the control command from the CPU 111.

In FIG. 2, a reference numeral 113 represents an image memory provided in the main controller 11 in order to store the image supplied from the external apparatus such as a host computer via the interface 112. A reference numeral 106 represents a ROM for storage of an operation program executed by the CPU 101 and control data used for controlling the engine part EG. A reference numeral 107 represents a RAM for temporary storage of operation results given by the CPU 101 and other data.

Further, there is a cleaner 76 in the vicinity of the roller 75. The cleaner 76 moves nearer to and away from the roller 75 driven by an electromagnetic clutch not shown. In a condition that the cleaner 76 is moved nearer to the roller 75, a blade of the cleaner 76 abuts on the surface of the intermediate transfer belt 71 mounted on the roller 75 and scrapes off the toner remaining on and adhering to the outer circumferential surface of the intermediate transfer belt 71 after the secondary transfer.

Furthermore, a density sensor 60 is disposed in the vicinity of the roller 75. The density sensor 60 confronts a surface of the intermediate transfer belt 71 and measures, as needed, the density of the toner image formed on the outer circumferential surface of the intermediate transfer belt 71. Based on the measurement results, the apparatus adjusts the operating conditions of the individual parts thereof that affects the image quality such as a developing bias applied to each developer, the intensity of the exposure beam L, and tone-correction characteristics of the apparatus, for example.

The density sensor 60 is structured to output a signal corresponding to a contrasting density of a region of a predetermined area defined on the intermediate transfer belt 71 using a reflective optical sensor, for example. The CPU 101 is adapted to detect image densities of individual parts of the toner image on the intermediate transfer belt 71 by periodically sampling the output signals from the density sensor 60 while moving the intermediate transfer belt 71 in rotation.

Restriction of a toner layer on the developing roller 44 within the developer 4K, . . . of the image forming apparatus having the structure above will now be described in detail. In a structure as that described above in which the surface of the developing roller 44 for carrying toner has concavity and convexity, it is possible for both the convex sections 441 and the concave section 442 of the developing roller 44 to carry toner. However, in this embodiment, it is structured that the restriction blade 46 abuts on the developing roller 44 within the surface of the developing roller 44 directly to remove toner on the convex sections 441. The reason is as described below.

First, the distance between the restriction blade 46 and the convex sections 441 needs be controlled precisely in order to form a uniform toner layer on the convex sections 441. However, for carrying of toner only by the concave section 442, the restriction blade 46 may abut on the convex sections 441 and remove all toner on the convex sections 441, which can be realized relatively easily. Further, since the volume of the space defined between the restriction blade 46 and the concave section 442 determines the amount of transported toner, it is possible to stabilize a transported toner amount.

This provides another advantage with respect to superiority of a transported toner layer. That is, carrying of toner by the convex sections 441 tends to degrade toner because of friction contact of the toner with the restriction blade 46. More specifically, there are problems such as reduction of the fluidity and the charging performance of toner, clumping together due to toner particles pressed to each other, and filming due to fixedly adherence of toner to the developing roller 44. In contrast, carrying of toner by the concave section 442 which is less influenced by the pressure from the restriction blade 46 is less likely to give rise to such problems. Further, the manner of friction contact on the restriction blade 46 is greatly different between toner carried by the convex sections 441 and toner carried by the concave section 442. Hence, their charge levels are predicted to largely vary from each other. However, carrying of toner by the concave section 442 alone makes it possible to suppress such variations.

The recent years in particular have seen a growing demand for size reduction of toner particles and a lower fixing temperature to enhance the resolution of an image and reduce the amount of consumed toner and electric power consumption. The structure described above meets the demand. Small-particle toner generally has a high saturation charge level but gets charged slowly at the beginning, and hence, toner carried by the convex sections 441 tends to have a significantly higher charge level (get excessively charged) than toner carried by the concave section 442. A charge level difference thus created shows itself as a development history in an image. Further, with respect to toner having a low melting point, fixing of toner to each other and fixing of the toner to the developing roller 44 and the like could easily occur by the friction contact of toner with each other or with the developing roller 44. However, such a problem is less likely to occur where the structure described above is used in which only the concave section 442 carries toner.

Next, a problem of toner adhesion to the seal member 47 as a subject matter of the invention is studied. The above problems such as toner adhesion could occur not only to the restriction blade 46 and the developing roller 44, but also to the seal member 47. As shown in FIG. 4A, the seal member 47 is held in contact with the surface of the developing roller 44 in the trail direction. Such a construction is necessary in preventing the toner from scattering to the outside of the developer, which may, however, result in toner fixation to the developing roller 44 and the seal member 47 because the toner on the developing roller 44 is sandwiched between the developing roller 44 and the seal member 47 to be pressed by them.

Figure 7A:
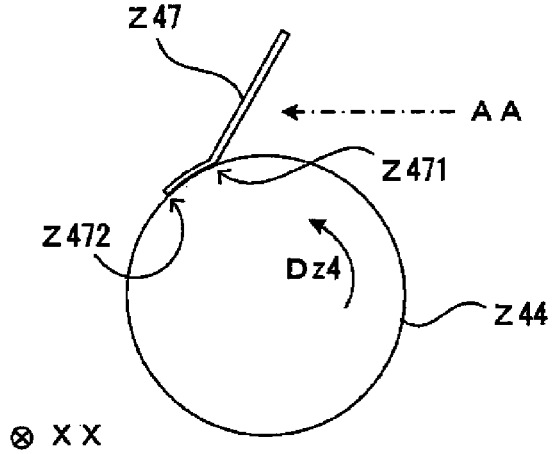
FIG. 7A Related Art
FIGS. 7A and 7B are schematic diagrams showing condition of toner fixation in the image forming apparatus of related art.
Figure 7B:
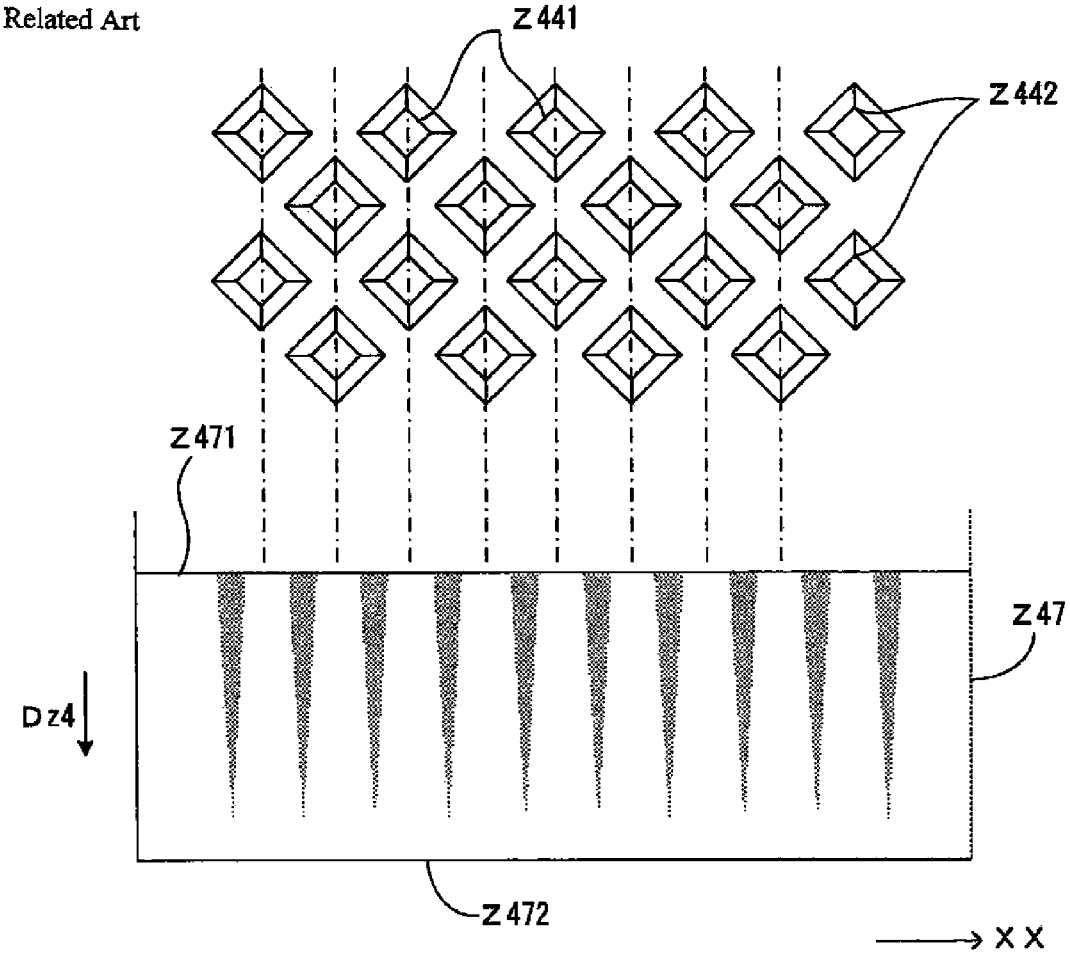
FIG. 7B Related Art

FIGS. 7A and 7B are schematic diagrams showing condition of toner fixation in the image forming apparatus of related art. The condition of the surface of a seal member Z47 is observed with the seal member Z47 abutting on a developing roller Z44 which rotates in a rotation direction Dz4 as shown in FIG. 7A. The structure of the surface of the developing roller Z44 is as described in above JP-A-2007-121948, and includes a large number of regularly arranged convex sections Z441 whose top surfaces are shaped approximately like rhombuses as shown in FIG. 7B. In this structure, leading-side apexes Z442 of the respective convex sections Z441 in the moving direction Dz4 of the surface of the developing roller Z44 in accordance with rotation of the developing roller Z44 are aligned along a line orthogonal to an axial direction XX.

In such an apparatus, when the surface of the seal member Z47 was observed in a direction of an arrow AA shown in FIG. 7A, streaky toner fixation as if trailing from an upstream end Z471 toward a downstream end Z472 in the rotation direction Dz4 of the developing roller Z44 was confirmed in a surface area of the seal member Z47 held in contact with the developing roller Z44 as shown in FIG. 7B. These streaks are aggregation or fusion of toner particles and additives separated from the toner particles on the seal member Z47. These streaks cyclically appear in an axial direction (XX direction) and this cycle is correlated with the arrangement pitch of the convex sections Z441 on the surface of the developing roller Z44.

This phenomenon can be described using the following model. Of each convex section Z441, the leading-side apex Z442 on the front-most side in the moving direction Dz4 associated with rotation of the developing roller Z44 functions to scrape off toner adhering to the surface of the seal member when this leading-side apex abuts on the seal member Z47. It is considered that thus scraped toner gets pushed away to the right-hand side and the left-hand side along ridge lines of the top surface of the convex section Z441. As shown in FIG. 7A, since the positions of the leading-side apexes Z442 of the respective convex sections Z441 overlap with each other in the direction XX in this developing roller, positions at which the leading-side apexes Z442 of the convex sections Z441 abut on the seal member and positions at which these leading-side apexes do not abut on the seal member alternately appear in the direction XX on the surface of the seal member. For this reason, adhering toner gets efficiently removed at the abutting positions where the leading-side apexes Z442 abut on the seal member, whereas at those positions where the abutting does not occur, the toner removal effect is small and removed toner flows to those positions from around. In consequence, streaky cyclical toner fixation corresponding to the pitches of the convex sections Z441 appears on the surface of the seal member.

In light of this, the arrangement of the convex sections on the surface of the developing roller is improved to prevent toner fixation to the surface of the seal member according to this embodiment. That is, in this embodiment, the convex section columns on the surface of the developing roller 44 are slightly tilted instead of being orthogonal to the axial direction X as shown in FIG. 6. The resultant toner adhesion preventing effect on the seal member will now be described.

Figure 8:
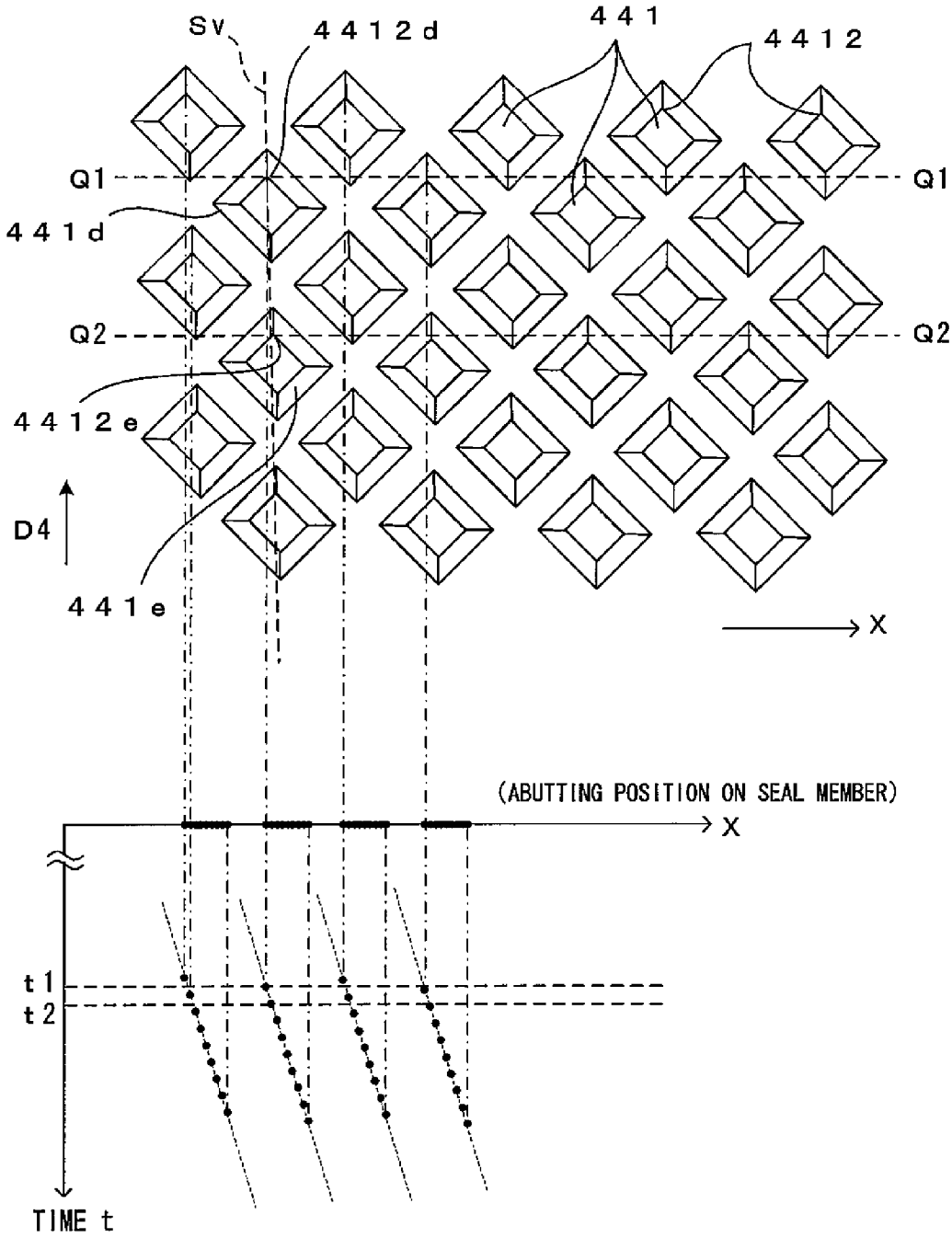
FIG. 8 is a view for describing the toner adhesion preventing effect realized by the seal member in this embodiment.

FIG. 8 is a view for describing the toner adhesion preventing effect realized by the seal member in this embodiment. On the surface of the developing roller 44 in this embodiment, the convex sections 441 are provided along the line Sv which is in a slightly different direction from the moving direction D4 of the surface of the developing roller as shown in FIG. 8. Hence, when the developing roller 44 rotates, the leading-side apexes 4421 of the convex sections 441, while gradually changing their positions, abut one after another on the surface of the seal member 47.

Assuming for instance that at time t1, of a surface region of the seal member 47 abutting on the developing roller 44, the upstream-most end portion in the rotation direction D4 of the developing roller 44 is on the line Q1-Q1 shown in FIG. 8, a leading-side apex 4412*d* of the convex section 441*d* among the respective convex sections abuts on the upstream-most end portion of the seal member 47. At time t2 after the developing roller 44 has rotated, a leading-side apex 4412*e* of the convex section 441*e* located approximately behind the convex section 441*d* abuts on the upstream-most end portion of the seal member 47 at a slightly deviated position (toward the right-hand side in FIG. 8) from the position at which the apex 4412*d* earlier abutted on the upstream-most end portion. In a similar fashion, as the developing roller 44 rotates, the abutting position at which the leading-side apexes of the convex sections abut on the seal member 47 shift gradually. This holds true as for other positions in the axial direction X as well.

When the abutting position at which the leading-side apexes 4412 of the convex sections 441 abut on the seal member 47 at each time are projected onto the axis X, a group of thus projected points expresses all such locations within the upstream-most end portion of the seal member 47 at which the abutting on the leading-side apexes of the convex sections 441 can occur in accordance with rotation of the developing roller 44. Although shown in FIG. 8 only partially, in this embodiment, these points projected upon the axis X are aligned on the axis X almost without any gaps between the points. This means that almost all regions within the surface of the seal member 47 are subjected at least once to abutting on the leading-side apexes 4412 of the convex sections 441 while the developing roller 44 rotates one round.

As described above, when abutting on the seal member 47, the leading-side apexes 4412 of the convex sections 441 function to scrape off toner which is on the seal member 47. Hence, in this embodiment, by the rotation of the developing roller 44, almost all regions of the seal member 47 are subjected to the function of scraping off of toner due to the abutting of the leading-side apexes 4412 of the convex sections 441 on the seal member 47. The effect of scraping off toner which has adhered to the seal member 47 is thus obtained in almost all regions in this embodiment. Hence, toner fixation to the seal member 47 is prevented, and streaky cyclical toner fixation as in the related techniques in particular do not appear.

Next, quantitative requirements for effective prevention of toner fixation to the seal member 47 will be described. In order to attain the toner scraping effect by the leading-side apexes 4412 of the convex sections 441 in almost all regions of the seal member 47, the smaller the portions within the surface of the seal member 47 not abutting on the leading-side apexes 4412 of the convex sections 441 are, the better. Further, the narrower the width in the axial direction (the direction X) of those portions where the abutting does not occur is, the better.

Figure 9:
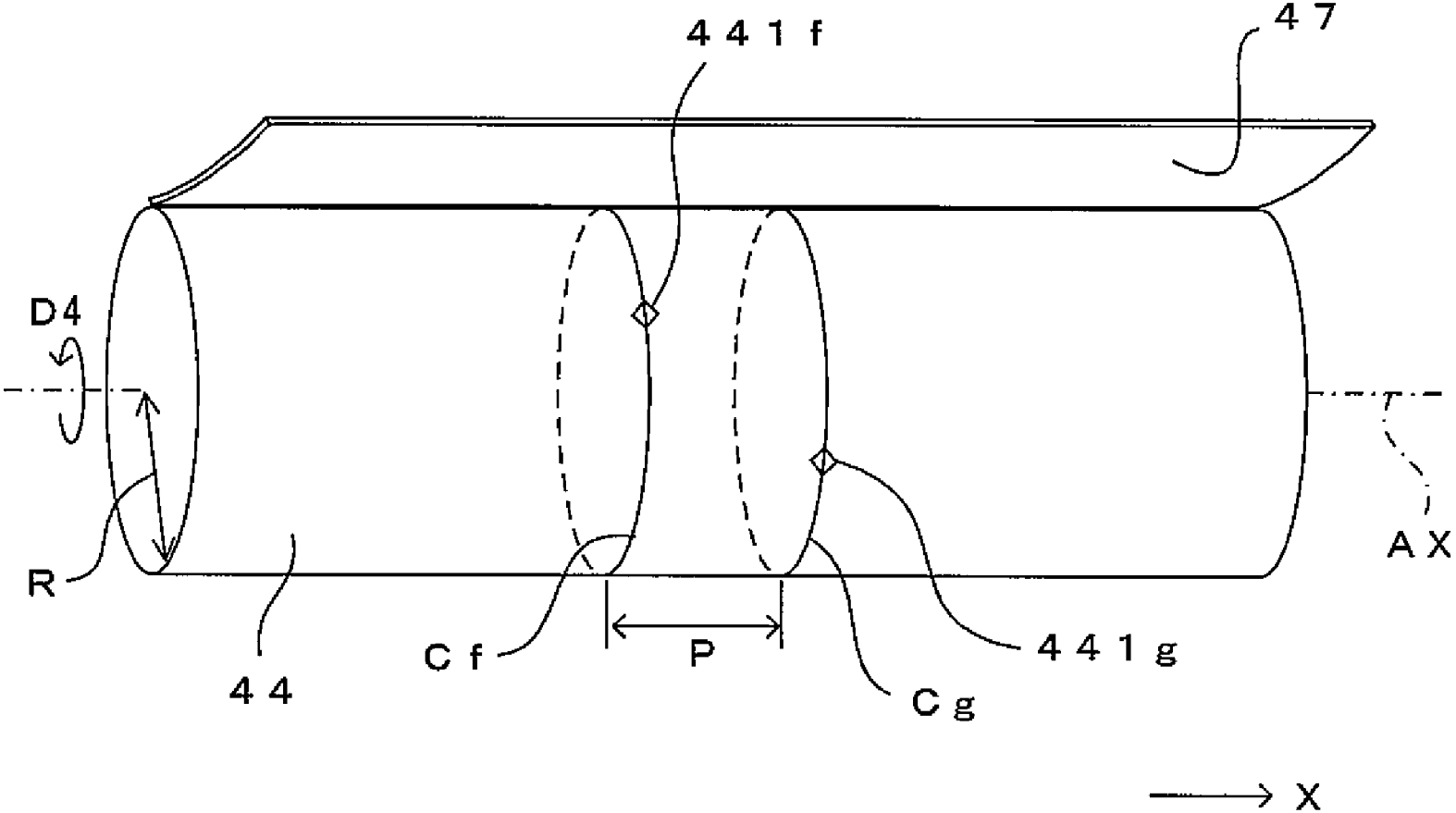
FIG. 9 is a diagram showing the trajectory of the leading-side apexes of the convex sections with the rotation of the developing roller.

FIG. 9 is a diagram showing the trajectory of the leading-side apexes of the convex sections with the rotation of the developing roller. Considering a chosen convex section 441*f* on the surface of the developing roller 44, one can define a circle Cf about a rotational axis AX of the developing roller 44 which passes through the leading-side apex of the top surface of this convex section. The circle Cf expresses the trajectory of the leading-side apex of the convex section 441*f* in accordance with the rotation of the developing roller 44. The circle Cf will be hereinafter referred to as "the trajectory circle" of this convex section 441*f*. Of the surface regions of the seal member 47 abutting on the surface of the developing roller 44, at positions on the trajectory circles, the toner scraping effect by the leading-side apex of the convex section 441*f* can be expected.

In a similar manner, it is possible to define similar trajectory circles with respect to other convex sections as well which are on the surface of the developing roller 44. Let us assume now that the symbol Cg denotes a trajectory circle about the rotational axis AX of the developing roller 44 which passes through the leading-side apex of other convex section 441*g* and the symbol P denotes a distance between the two trajectory circles Cf and Cg in the direction X.

If trajectory circles of all convex sections are imagined on the surface of the developing roller 44, a number of circles must be surrounding the surface of the developing roller 44. Of these, the areas in the gaps between these trajectory circles are where the toner scraping effect upon the surface of the seal member 47 by the convex sections is weak. Hence, it is desirable that the distances P between the adjacent trajectory circles are as small as possible to obtain the toner scraping effect favorably on the entire surface of the seal member 47. More concretely, it is preferable that even the widest gap is smaller than the volume average particle diameter of toner which is used.

When there are gaps between the trajectory circles which are equal to or larger than the volume average particle diameter of toner, corresponding portions within the surface of the seal member 47 accept adhesion of toner whose particle diameters are average or larger. Toner adhering in this fashion leads to adhesion of more toner, whereby resulting in gradual toner fixation to the surface of the seal member 47. On the contrary, in the event that the distances P between the trajectory circles, even when the largest, are smaller than the volume average particle diameter of toner, the abutting on the convex sections removes without fail toner having the average or larger particle diameters.

It is particularly more preferable that between two adjacent convex sections on a convex section column (for example, the convex section 441*a* and the convex section 441*b* shown in FIG. 6), a difference L3 in the axial direction between the positions of the leading-side apexes of the top surfaces of these convex sections is smaller than the volume average particle diameter of toner. Further, it is more preferable that deviations in the axial direction between the positions of adjacent convex sections along the convex section columns are uniform and the direction thereof is the same. The reason is as described below. In principle, portions in the surface of the seal member 47 may abut on the apexes of the convex sections at least once while the developing roller 44 rotates one round, and in this regard, the apexes of the convex sections may abut on the seal member 47 at randomly changing abutting positions as the developing roller 44 rotates.

However, if abutting by the convex sections occurs at greatly changing positions every time, toner not completely removed through abutting by one convex section or toner pushed away to the side in the axial direction, when abutting on a different portion than the apex of the next convex section, could be pressed against the seal member rather than getting scraped off by the next convex section. To prevent this and to remove toner without fail, it is desirable that the abutting position at which the apex of one convex section abuts on the seal member and the abutting position at which the apex of other convex section abuts on the seal member after the earlier convex section are different from each other and a difference between these abutting positions is as small as possible and, even when the largest, is smaller than the volume average particle diameter of toner. In addition, it is desirable that deviations in the axial direction between the convex sections are in the same direction so that toner will not move reciprocally in particular regions on the seal member.

Since the top surface 4411 of each convex section 441 is shaped approximately as a tilted parallelogram in this embodiment, it is one of the apexes of this parallelogram that is located the front-most in the moving direction D4 of the surface of the developing roller 44 and abuts on the seal member 47 first in accordance with rotation. Hence, the trajectory circle which this apex follows does not have any width, which makes it impossible to overlap the trajectory circles of the respective convex sections in a strict sense. However, when such convex sections are provided in which each leading-side apex 4412 is replaced with a side of the convex section which is parallel to the axial direction and on the front side in the moving direction D4 of the surface of the developing roller 44, the trajectory of this side forms a cylindrical shape which has a constant width, and therefore, it is possible to overlap the cylindrical shapes and eliminate the gaps between the cylindrical shapes. At this time, the convex sections always abut on all regions within the surface of the seal member 47, which makes it possible to remove adhering toner more securely.

Alternatively, utilizing the dimensions of the respective portions shown in FIG. 6, the values L1, L2 and L3 related to the dimensions and the arrangement of the convex sections 441 may be set so that the following relationship is satisfied:

$$(2\pi R/L1)\cdot L3 \geqq L2 \qquad \text{(Formula 1)}$$

where the symbol R denotes the radius of the enveloping cylindrical surface of the developing roller 44. This formula means the following.

In the formula above, the value (2πR) is indicative of the circumference of the enveloping cylindrical surface. Hence, the value (2πR/L1) which is calculated by dividing this value by the distance L1 between the apexes of two adjacent convex sections on a convex section column expresses the number of the convex sections which are present over the circumference of the developing roller 44. Consequently, the value expressed by the left-hand side of the Formula 1 which is calculated by multiplying this value (2πR/L1) by the value L3 which corresponds to the amount of a deviation between the positions of adjacent convex sections on a convex section column is integration of this positional deviation over the circumference of the developing roller. In the meantime, the value L2 in the right-hand side of the Formula 1 expresses the distance between two adjacent convex section columns.

Therefore, what the Formula 1 means is a relationship that the amount of movement of the abutting position at which each convex section 441 belonging to a certain convex section column abuts on the seal member 47 during one rotation of the developing roller 44 is equal to or larger than the pitch of adjacent convex section columns. As shown in FIG. 8, the abutting position at which one convex section belonging to a certain convex section column abuts on the seal member 47 moves in the axial direction of the developing roller 44 as the developing roller 44 rotates. Where the relationship expressed by the Formula 1 is satisfied, there arises no large gaps between the abutting positions at which the convex sections belonging to one convex section column abut on the seal member 47 and the abutting positions at which the convex sections belonging to another adjacent convex section column abut on the seal member. This discourages toner from staying on the surface of the seal member 47. A condition that the Formula 1 above is an equality is particularly preferable.

Figure 10:
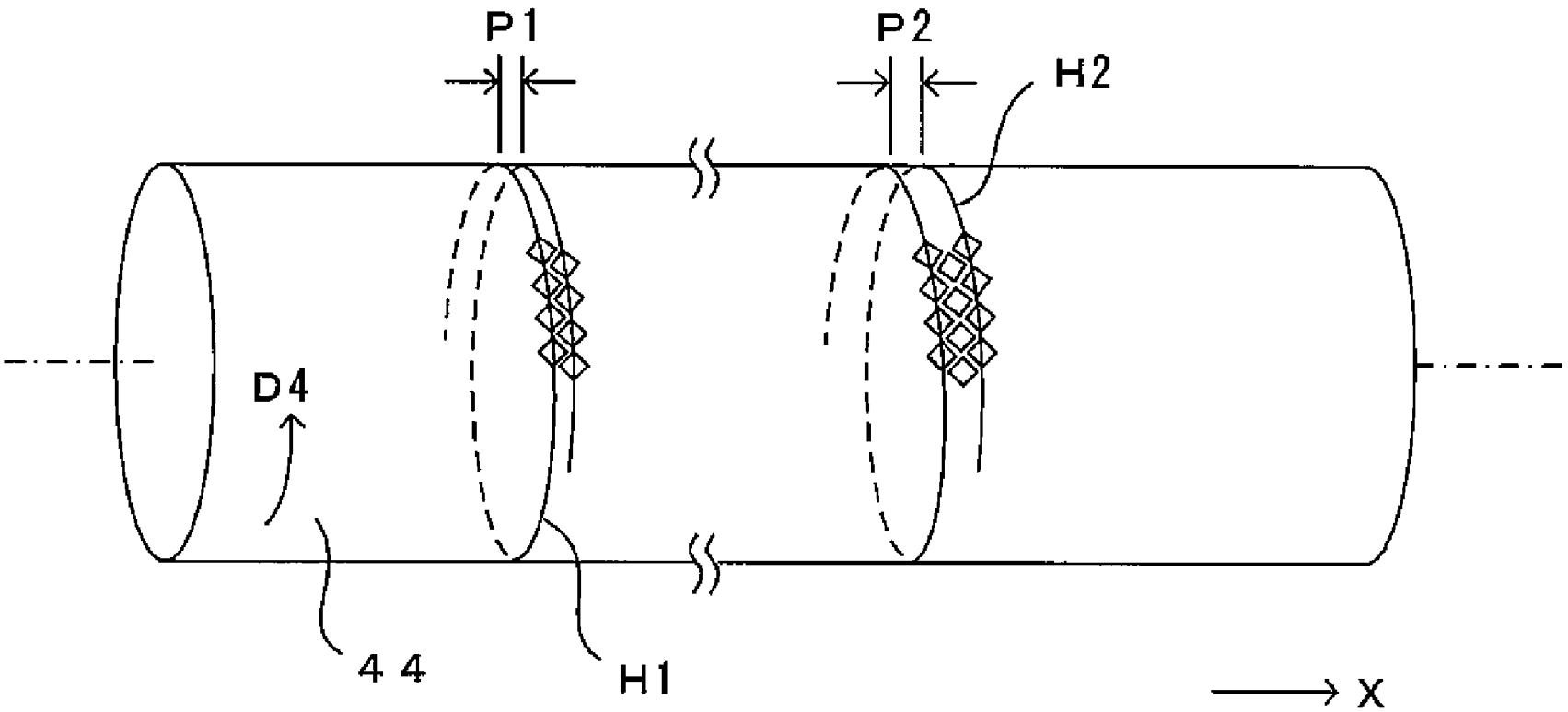
FIG. 10 is a diagram showing a preferable arrangement of the convex sections.

FIG. 10 is a diagram showing a preferable arrangement of the convex sections. The line Sv shown in FIG. 6 indicative of the arranging direction in which the respective convex section columns are arranged is a part of a helix on the enveloping cylindrical surface of the developing roller 44 since the leading-side apexes 4412*a*, 4412*b* and the like on the line Sv are all on this enveloping cylindrical surface. That is, the leading-side apexes 4412*a*, 4412*b* and 4412*c* of these convex sections are present on the same helix on the enveloping cylindrical surface of the developing roller 44.

As described above, when each of the leading-side apexes 4412 of the respective convex sections 441 which are aligned in the moving direction D4 of the surface of the developing roller 44 are sequentially connected with a line, the line becomes a helix which is on the enveloping cylindrical surface of the developing roller 44 as denoted at the symbols H1 and H2 in FIG. 10. The pitch of the helix is determined by a difference (that is, the value L1 in FIG. 6) in the moving direction D4 between the positions of adjacent convex sections in the moving direction D4 of the surface of the developing roller 44 and a difference (that is, the value L2 in FIG. 6) between the positions of the adjacent convex sections in the axial direction X. The pitch of the helix is the smallest in principle when the helix passing through one of the convex section columns on the surface of the developing roller 44 runs around the circumference of the developing roller 44 and further over an adjacent convex section column to this convex section column in the axial direction X as denoted at the symbol H1 in FIG. 10. At this time, the leading-side apexes of all convex sections on the developing roller 44 are on the same helix. The pitch P1 of the helix in this instance is the same as the pitch of the convex section columns and equal to the value L2 which is shown in FIG. 6.

In this instance, the positions at which the leading-side apexes 4412 of the respective convex sections 441 along the convex section columns abut on the seal member 47 gradually move in the axial direction as the developing roller 44 rotates, and when the developing roller 44 has just rotated one round, these positions come immediately close to the positions at which the convex sections belonging to the neighboring convex section column used to abut on the seal member. That is, in this instance, the leading-side apexes 4412 of the respective convex sections 441 provided on the surface of the developing roller 44 abut on the surface of the seal member 47 all at different positions, and two or more leading-side apexes will never abut on the surface of the seal member 47 at an identical position. At this time, the number of portions in which the leading-side apexes of the convex sections 441 abut on the surface of the seal member 47 becomes the greatest (that is, the same number as the number of the convex sections), and these portions are at minimum and constant intervals from each other. It is therefore possible to attain uniformly the effect of scraping off toner which has adhered to the seal member 47 in a wide region within the surface of the seal member 47.

A condition in which the Formula 1 above is an equality is a condition in which the respective convex sections 441 are located at these positions described right above. Specifically, when an integrated value of the amounts by which the positions of the convex sections 441 get deviated in the axial direction while the developing roller 44 rotates one round is the same as the pitch of the convex section columns, the leading-side apexes 4412 of the respective convex sections 441 abut on the surface of the seal member 47 all at different positions and these abutting positions are at constant intervals.

Although it is desirable that all convex sections 441 are provided on the same helix as described above, this is not necessarily essential in terms of obtaining a satisfactory and essential effect of scraping toner off. In other words, the respective convex sections 441 may be provided on a plurality of helixes. In the embodiment denoted at the symbol H2 in FIG. 10, the convex sections 441 are provided such that a helix 12 having a pitch P2 along a certain convex section column passes through the next convex section column to the immediately adjacent convex section column. The convex sections belonging to the convex section columns which are sandwiched by the convex section columns which are on the helix H2 are located on other parallel helix to this helix H2. That is, in this instance, one can say that the respective convex sections 441 on the developing roller 44 are located along a double-thread helix which is on the developing roller 44.

Where such an arrangement is implemented, while the developing roller 44 rotates one round, one portion in the surface of the seal member 47 abuts on two convex sections which respectively belong to convex section columns which are adjacent to each other. In other words, where the convex section columns are arranged as on a double-thread helix, while the number of times that the leading-side apexes of the respective convex sections abut on the same portion within the surface of the seal member 47 doubles as compared to where there is a single-thread helix provided, the gaps between the abutting portions as well double. That is, although the scraping effect improves as the number of abutting increases, the expanded gaps could more easily leave fine particles remaining on the seal member 47. However, this is not particularly a problem if the gaps between the abutting locations are smaller than predictable sizes of particles which need be removed from the surface of the seal member 47. This is similarly applicable to where a helix formed by more threads is provided.

As described above, in this embodiment, the convex sections are provided on the surface of the developing roller 44 such that the axial-direction positions of the leading-side apexes 4412 of the respective convex sections 441, which best scrape toner off, get shifted gradually. According to such a structure, the positions at which the leading-side apexes 4412 abut on the seal member 47 gradually change as the developing roller 44 rotates. Hence, the effect of scraping toner off remains uniform and it is possible to attain a strong effect of scraping off toner from all surface regions of the seal member 47 abutting on the surface of the developing roller 44. As a result, according to this embodiment, it is possible to prevent toner fixation to the seal member 47 and to obviate a problem such as toner leakage and a deteriorated image quality resulting from the toner fixation.

JP-A-2003-57940 (FIG. 4 in particular) discloses an arrangement that the axial-direction positions of the convex sections are gradually changed as described above. However, this patent publication does not describe at all how to set the amounts of the positional deviations of the convex sections, and to particularly note, does not consider at all a relationship with toner particle diameters, the shape of a helix formed by connecting the respective convex sections, etc.

Next, a method of manufacturing the developing roller 44 above will be described. A method of manufacturing the developing roller of related art shown in FIG. 7B, namely, a developing roller on a surface of which convex section columns are aligned in the moving direction of the surface of the developing roller is as described for example in JP-A-2007-127800, JP-A-2007-140080 and the like which are earlier disclosed by the applicant. In the meantime, it is possible to manufacture the developing roller 44 of this embodiment by a manufacturing method which is improvement over the manufacturing methods described in these patent publications. In more particular terms, it is possible to manufacture it with the shape of a die changed in the manner described below.

Figure 11:
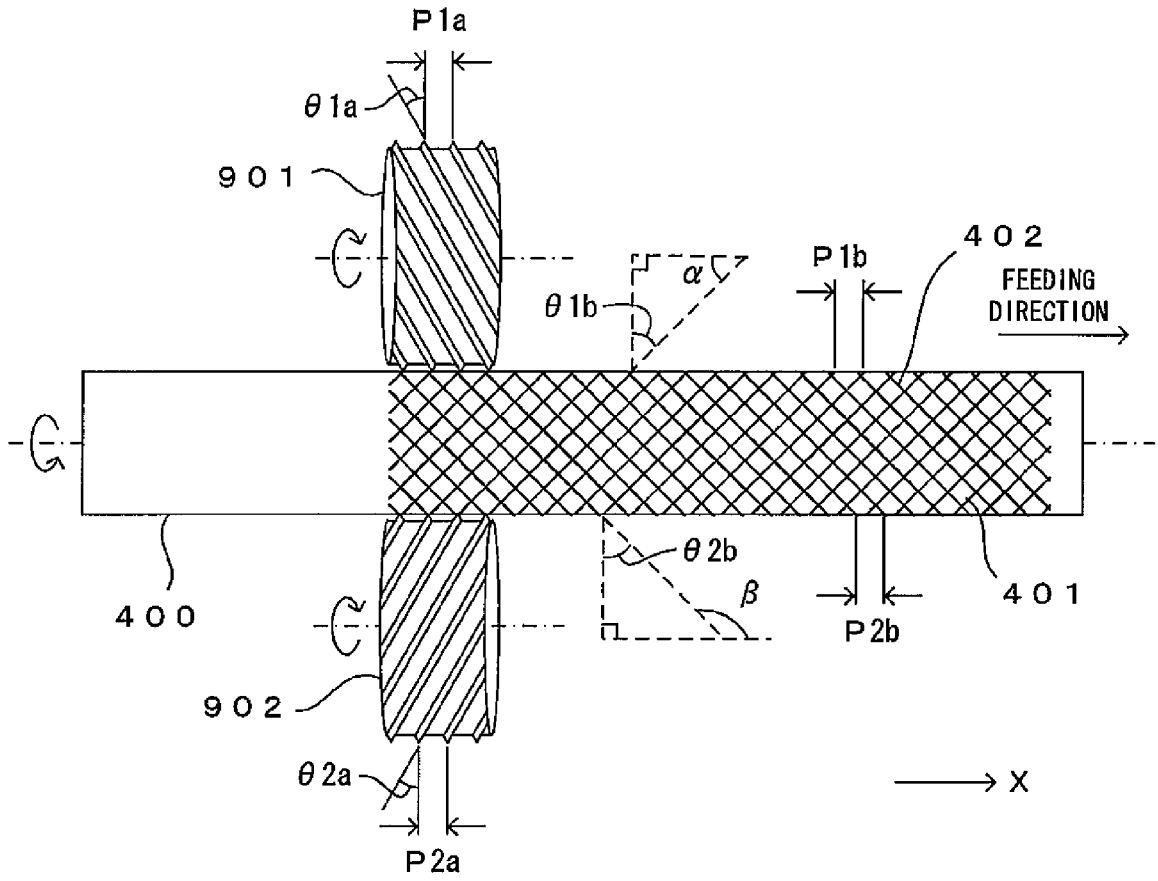
FIG. 11 is a diagram showing an outline of the method of manufacturing the developing roller according to the invention.

FIG. 11 is a diagram showing an outline of the method of manufacturing the developing roller according to the invention. It is possible to manufacture the developing roller 44 of this embodiment by forming two types of grooves which cross each other on a roller base member 400 which has a cylindrical shape and is made of metal or alloy such as copper, aluminum and stainless steel. Describing this in more detail, by a through feed rolling method in which a pair of dies 901 and 902 rotate in the same direction while being pressed against the surface of the roller base member 400 to feed the roller base member 400 in a predetermined direction, first grooves 401 and second grooves 402 which are helix-like grooves are formed as shown in FIG. 11.

The rotation shaft of the die 901 and the central axis of the roller base member 400 are not parallel but slightly tilted (by one degree for instance). Further, the rotation shaft of the die 902 and the central axis of the roller base member 400 are slightly tilted by the same amount (by minus one degree for instance) toward the opposite direction to the direction above. This makes thrust force attributable to rotation of the dies 901 and 902 act upon the roller base member 400, and therefore, when the dies 901 and 902 are rotated, the roller base member 400 is fed in the axial direction. In the embodiment shown in FIG. 11, by the rotation of the dies 901 and 902, the roller base member 400 is fed toward the right-hand side in FIG. 11 while rotating.

Each one of the dies 901 and 902 has a shape like a cylinder on the outer circumferential surface of which helically-formed projections are provided. The pitch of the helical arrangement on the die 901 will be hereinafter denoted at P1*a* and the helix angle of the die will be hereinafter denoted at θ1*a*. When the projections are pressed against the roller base member 400, the surface of the roller base member 400 exhibits plastic deformation and the helix-like first grooves 4θ1 are engraved at the pitch P1*b* and a helix angle θ1*b*. The helix angle θ1*b* of the first grooves can be determined by the helix angle θ1*a* of the projections of the die 901 and the inclination of the rotation shaft of the die 901 with respect to the central axis of the roller. Further, from a dotted line triangle shown in FIG. 11, one can easily see that a value calculated by subtracting the helix angle θ1*b* of the first grooves 401 from 90 degrees corresponds to the tilt angle α shown in FIG. 6. The first grooves 401 may be single-thread or multi-thread grooves and this decision may be selected depending upon the shape of the die.

Further, the helical pitch of the projections provided on the die 902 is denoted at P2*a* and the helix angle of the die 902 is denoted at θ2*a*. When the projections are pressed against the roller base member 400, the helix-like second grooves 402 are engraved at the pitch P2*b* and a helix angle θ2*b*. From a dotted line triangle shown in FIG. 11, one can see that a value calculated by adding the helix angle θ2*b* of the second grooves 402 to 90 degrees corresponds to the tilt angle β shown in FIG. 6. The second grooves 402 may as well be single-thread or multi-thread grooves.

In this manner, the two types of grooves which cross each other like a lattice are engraved on the outer circumferential surface of the roller base member 400, and these grooves function as the concave section 442 on the surface of the developing roller. Further, the numerous projections surrounded by the grooves function as the convex sections 441 which are on the surface of the developing roller. The top surfaces of the respective convex sections form the original surface of the roller base member 400, and each such top surface is naturally a part of a single cylindrical surface.

When the pitch of the die 901 for forming the first grooves and that of the die 902 for forming the second grooves are slightly different from each other and hold the relationship P1*a*≠P2*a*, the pitch P1*b* of the first grooves and the pitch P2*b* of the second grooves engraved on the surface of the roller base member 400 have different values from each other. The pitch P1*b* of the first grooves is related to the pitch A of the convex section columns shown in FIG. 6 while the pitch P2*b* of the second grooves is related to the pitch B of the convex section columns which are in another direction as shown in FIG. 6. Hence, it is possible to form the surface structure of the developing roller 44 of this embodiment in which the arrangement pitches A and B described above are different from each other.

It is desirable that the pitch ratio of the two sets of dies is a non-integer ratio. This is because if the pitch ratio is an integer ratio, a pattern for changing the positions of the convex sections is limited to alternate changes of some of these positions and the toner removal effect due to abutting on the convex sections is achieved only locally. For instance, where the pitch ratio is 1:2, the apexes of the convex sections belonging to one convex section column alternately switch between two positions in the axial direction but can not be located at any other different positions. Although the pitch of streaky toner fixation on the seal member decreases to the half the pitch which is shown in FIG. 7B, it is hard to ascertain that the toner removal effect is achieved sufficiently on the entire seal member.

Further, as for the die 901 for forming the first grooves and the die 902 for forming the second grooves as well, their helix angles θ1*b* and θ2*b* (or more strictly speaking, angles calculated by adding the inclination of the rotation shafts of the dies to these angles) may be set to slightly different values from each other so that the helix angles θ1*b* and θ2*b* of the first and the second grooves formed on the roller base member 400 are different from each other. In this instance as well, it is possible to form convex section columns whose axial-direction positions gradually change although the resultant arrangement is somewhat different from the arrangement shown in FIG. 6.

Figure 12:
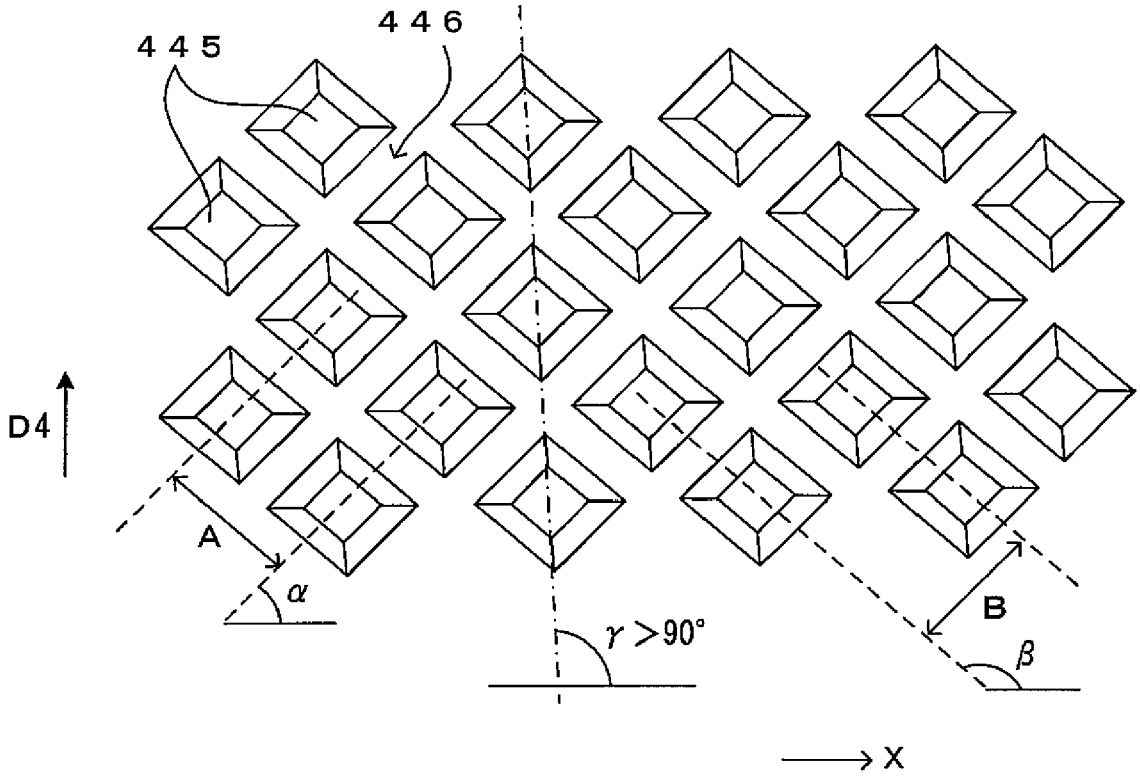
FIG. 12 is a diagram showing other embodiment regarding the shape and the arrangement of the convex sections.

FIG. 12 is a diagram showing other embodiment regarding the shape and the arrangement of the convex sections. An instance will now be described below that the pitches of the two sets of dies are the same, whereas the helix angles θ1*b* and θ2*b* are different from each other and the surface of the roller base member 400 is processed in a similar manner to that shown in FIG. 11. In this instance, as shown in FIG. 12, two types of grooves corresponding to these helix angles are engraved on the surface of the developing roller, thereby forming concave section 446 and an arrangement of convex sections 445 which are surrounded by these grooves and whose arrangement pitches A and B are the same and tilt angles α and β are different from each other by other angle than the right angle. In such a structure as well, the angle γ of the direction X with respect to a line connecting leading-side apexes 4452 of top surfaces 4451 of the convex sections 445 which are adjacent to each other in the same convex section column has a different value from 90 degrees. That is, this structure as well makes it possible for the convex sections 445 abutting on the seal member to gradually change their positions in the axial direction X as the developing roller rotates, and hence, scrape off toner at the corresponding locations on the seal member.

Figure 13:
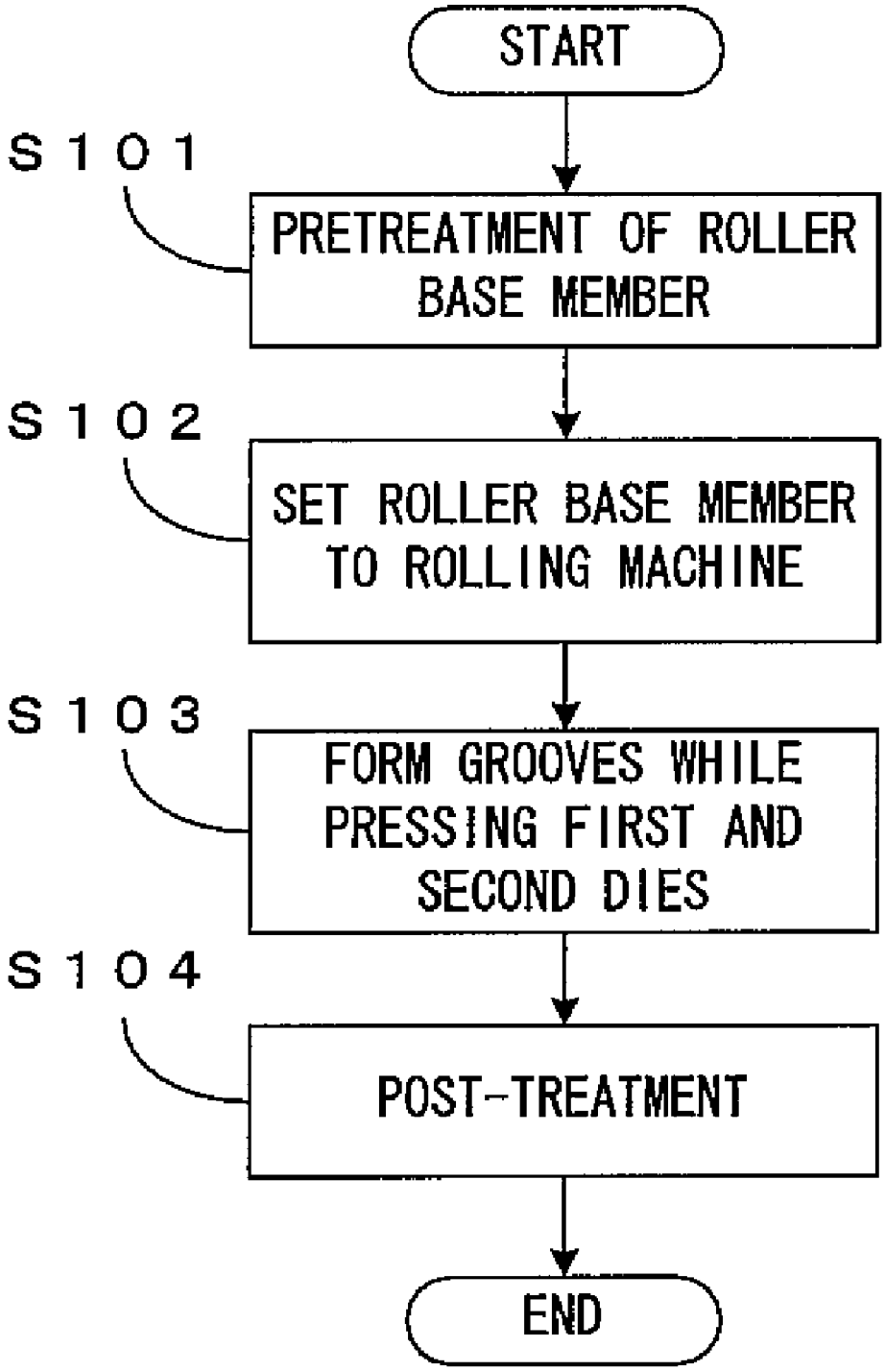
FIG. 13 is a flow chart showing the method of manufacturing the developing roller according to the invention.

FIG. 13 is a flow chart showing the method of manufacturing the developing roller according to the invention. First, the roller base member 400 is processed by pretreatment (Step S101). The pretreatment includes for example manufacturing of a metallic cylinder or column which will later become the roller base member 400, smoothing of the surface of the cylinder or column, etc. After setting the roller base member 400 to a rolling machine not shown (Step S102), the first die, namely, the die 901 and the second die, namely, the die 902 rotate while staying pressed against the roller base member 400, whereby the first grooves 401 and the second grooves 402 are formed (Step S103). As the first and the second dies rotate, the roller base member 400 is fed in the axial direction while rotating, which makes it possible to form the first and the second grooves continuously in predetermined regions on the surface of the roller base member 400. Finally, post-treatment is performed which may be cleaning of the roller base member 400 on which the two types of grooves are formed and heat treatment which aims at eliminating surface stress (Step S104), thereby completing processing of the roller base member which will later become the developing roller.

As described above, by this manufacturing method, it is possible to manufacture a developing roller which comprises convex sections which partially form a single cylindrical surface together with concave section surrounding the convex sections in such a manner that the convex sections are arranged in a moving direction of the surface of the developing roller associated with the rotation thereof and the axial-direction positions of the convex sections gradually change. As thus manufactured developing roller rotates while abutting on the seal member, toner adhering to the seal member can be effectively removed.

While the above-mentioned patent publication JP-A-2007-140080 by the applicant describes that two types of grooves may be formed using dies which are different from each other (in the paragraph 0012 for instance), it does not specifically reveal the shapes of the dies to combine or a technical significance which a developing roller manufactured based on this combination has.

FIG. 14 is a table for describing the effect of the invention. Four types of developing rollers whose dimensions of the respective parts are shown as the numerical value examples 1 through 4 in FIG. 14 were manufactured and their characteristics were evaluated. The tilt angles α and β defining the arrangement of the convex sections in an oblique direction were kept constant while the pitches A and B were changed. The evaluation was made as for (1) if filming on the seal member 47 occurred due to fixed toner, (2) if filming on the surface of the developing roller 44, and in particular, the convex sections 441 of the developing roller 44 occurred due to fixed toner, (3) if adhesion of toner to the developing roller and the like caused stripe-like image defects (stripe images), (4) if the development history phenomenon occurred due to whether the charge resetting characteristic of toner carried on the surface of the developing roller is good, (5) the degree of fogging on an image, and (6) the extent of scattering of toner to outside the developers.

As the numerical value examples 1 and 2 show, favorable results were obtained with respect to these evaluation items when the amount L3 of deviations between the axial-direction positions of adjacent convex sections in a convex section column was smaller than the volume average particle diameter of toner Dave and an integrated value $(2\pi R/L\mathbf{1})\cdot L\mathbf{3}$ of the positional deviations over the circumference of the developing roller was equivalent to or larger than the pitch L2 of the convex section columns in the axial direction. To note in particular, the result was the best when the integrated value $(2\pi R/L\mathbf{1})\cdot L\mathbf{3}$ of the positional deviations over the circumference of the developing roller was almost equal to the pitch L2 of the convex section columns in the axial direction.

On the contrary, it was not possible to obtain a good result on any evaluation item with the structure according to the numerical value example 3 that the integrated value $(2\pi R/L\mathbf{1})\cdot L\mathbf{3}$ of the positional deviations over the circumference of the developing roller is smaller than the pitch L2 of the convex section columns in the axial direction or the structure according to the numerical value example 4 that the amount L3 of deviations between the axial-direction positions of adjacent convex sections in a convex section column is larger than the volume average particle diameter of toner Dave. It then follows that the invention effectively contributes to prevention of toner fixation to the seal member, the developing roller, etc.

The invention is not limited to the embodiment described above but may be modified in various manners in addition to the embodiment above, to the extent not deviating from the object of the invention. For instance, in the method of manufacturing the developing roller described above, the so-called through feed rolling method in which the surface of the roller base member is plastically deformed by pressing a rotating die against the roller base member is used to form the concave/convex surface structure of the developing roller. However, this is not limiting. Instead, a cutting tool may be pressed against the roller base member which is moved in the axial direction while rotating and the surface of the roller base member may accordingly be cut, to thereby form the grooves.

Further, in the manufacturing method described above, although the two types of grooves which cross each other are simultaneously formed, the two types of grooves may be formed separately from each other at separate steps for instance.

In addition, the developing roller according to the embodiment described above is manufactured by through feed rolling for forming two types of grooves which cross each other, and therefore, comprises a number of convex sections whose top surfaces are shaped approximately like parallelograms. However, the shape of the convex sections is not limited to this to the extent that the shape satisfies the requirements of the invention. Further, the developing roller may be manufactured by other manufacturing methods.

Further, the tilt angles $\alpha$ and $\beta$ defining the arrangement of the convex sections in an oblique direction are 45 degrees and 135 degrees, respectively, in the developing roller 44 in the embodiment described above. However, these numerical values are not limiting but may be modified appropriately. The dimensions of the respective parts may also be modified appropriately.

In the above respective embodiments, the invention is applied to the image forming apparatus employing a so-called rotary development method in which a plurality of developers are mounted in the rotating rotary developer unit. An application subject of the invention is not limited to this and the invention is also applicable, for example, to an image forming apparatus employing a so-called tandem development method in which a plurality of developers are arranged in a rotation direction of a transfer medium or to a monochromatic image forming apparatus including only one developer.

As described above, in the above embodiment, the developers 4Y, 4M, 4C and 4K function as the "developer apparatuses" of the invention and the developing roller 44 functions as the "toner carrier roller" of the invention. In the surface of the developing roller 44 according to the embodiment described above, the leading-side apexes 4412 of the top surfaces 4411 which the respective convex sections 441 have correspond to the "leading portions" of the invention. The convex section 441*a* and the convex section 441*c* viewed from the convex section 441*b* shown in FIG. 6 correspond respectively to the "front-side neighboring convex section" and the "rear-side neighboring convex section" of the invention. In the embodiment described above, the photosensitive member 22 functions as the "latent image carrier" of the invention.

Further, in the embodiment described above, the dies 901 and 902 function respectively as the "first tool" and the "second tool" of the invention.

In the manufacturing method of an embodiment according to an aspect of the invention, for instance, in the forming the first grooves, a first tool that includes projections to form the first grooves may be pressed against the outer circumferential surface of the roller base member and the roller base member may be moved in an axial direction thereof while being rotated, in the forming the second grooves, a second tool that includes projections to form the second grooves may be pressed against the outer circumferential surface of the roller base member and the roller base member may be moved in the axial direction thereof while being rotated, and shapes of the first tool and the second tool may be different from each other. In this way, as the surface of the roller base member is processed with the two types of tools whose shapes are different from each other, a toner carrier roller capable of suppressing adhesion of toner to the seal member can be manufactured.

The processing may be attained by cutting or rolling. Further, as the two types of tools may be pressed against the surface of the roller base member at mutually different positions, to thereby execute the forming the first grooves and the forming the second grooves concurrently.

For instance, the roller base member may be rotated with the first tool comprising the projections to form the first grooves and the second tool comprising the projections to form the second grooves pressed against the roller base member, to thereby execute the forming the first grooves and the forming the second grooves at the same time. In this fashion, it is possible to efficiently manufacture a toner carrier roller exhibiting the characteristics described above in a short period of time.

Further, in the developer apparatus and the image forming apparatus according to some aspects of the invention, it is possible to ensure that the entire region of the surface of the roller base member abuts on the leading portions when the maximum value of the gaps between the trajectories is zero, and hence, it is possible to maximize the effect of scraping toner off.

With respect to each convex section, the gap in the axial direction, which is parallel to the rotational axis of the toner carrier roller, between the leading portion of one convex section and the leading portion of one of the neighboring convex sections whose position is least different in the axial direction may be greater than zero but smaller than the volume average particle diameter of toner.

A fact that the gap between the leading portion of one convex section and that of a neighboring convex section is zero in the axial direction means that these convex sections are at the same position in the axial direction. In such a structure however, the leading portions of the both convex sections abut on the surface of the roller base member at the same location and attain the toner scraping effect only locally. In contrast, where the axial-direction positions of the both convex sections are different, the respective leading portions attain the toner scraping effect at mutually different positions within the surface of the roller base member. When the difference between the positions of these leading portions is smaller than the volume average particle diameter of toner, it is possible to securely scrape off toner having average or larger particle sizes from the surface of the seal member.

Alternatively, with respect to each convex section, the leading portion of a front-side neighboring convex section, namely, one of neighboring convex sections on the front side to the convex section in the moving direction whose position is least different in the axial direction which is parallel to the rotational axis of the toner carrier roller, and the leading portion of a rear-side neighboring convex section, namely, one of neighboring convex sections on the rear side to the convex section in the moving direction whose position is least different in the axial direction which is parallel to the rotational axis of the toner carrier roller, may be at different positions from each other in the axial direction.

In this structure, as the front-side neighboring convex section, one convex section and the rear-side neighboring convex section abut on the seal member in turn in accordance with rotation of the toner carrier roller, the abutting positions of the leading portions are all different from each other. It is therefore possible to scrape toner off without fail. It is particularly preferable that the front-side neighboring convex section and the rear-side neighboring convex section are on the opposite sides to each other across one convex section in the axial direction. This makes it possible to gradually move in the axial direction positions at which the leading portions abut on the seal member as the toner carrier roller rotates, namely, positions at which the toner scraping effect is obtained, which permits next leading portions to scrape off toner which was not removed by earlier leading portions.

It is desirable that the top surfaces of the plurality of convex sections have apexes which project the most toward the front side in the moving direction and that the apexes form the leading portions. Since such apexes are greatly effective in scraping toner off, the leading portions of the apex surfaces comprising such apexes are capable of effectively scraping toner off from the surface of the seal member.

Although the invention has been described with reference to specific embodiments, this description is not meant to be construed in a limiting sense. Various modifications of the disclosed embodiment as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A developer apparatus, comprising:

a housing that stores toner inside;

a toner carrier roller that is shaped approximately like a cylinder, is mounted to the housing rotatably about a rotational axis, rotates while carrying toner on a surface thereof to convey the toner to outside the housing, and is provided, on the surface thereof with a plurality of convex sections which are regularly arranged and a concave section which surrounds the convex sections, the convex sections including top surfaces that coincide with a part of a cylindrical surface of a single cylinder; and a seal member that is arranged in abutting contact with the surface of the toner carrier roller moving from the outside the housing toward the inside the housing to prevent toner leakage from the inside the housing, wherein out of surrounding area of the top surface of each of the convex sections, a portion located at front-most in a moving direction associated with rotation of the toner carrier roller is a leading portion of the convex section, and a maximum value of gaps in an axial direction, which is parallel to the rotational axis of the toner carrier roller, between the trajectories which the leading portions of the convex sections follow while the toner carrier roller rotates one round is smaller than a volume average particle diameter of the toner.

2. The developer apparatus of claim 1, wherein the maximum value of the gaps is zero.

3. The developer apparatus of claim 1, wherein with respect to each convex section, a gap in the axial direction, which is parallel to the rotational axis of the toner carrier roller, between the leading portion of one convex section and that of one of neighboring convex sections whose position is least different in the axial direction is greater than zero but smaller than the volume average particle diameter of the toner.

4. The developer apparatus of claim 3, wherein with respect to each convex section, the leading portion of a front-side neighboring convex section, which is one of neighboring convex sections on a front side to the convex section in the moving direction whose position is least different in the axial direction from that of the convex section, and the leading portion of a rear-side neighboring convex section, which is one of neighboring convex sections on a rear side to the convex section in the moving direction whose position is least different in the axial direction from that of the convex section, are at different positions from each other in the axial direction.

5. The developer apparatus of claim 4, wherein the front-side neighboring convex section and the rear-side neighboring convex section are on opposite sides to each other across the convex section in the axial direction.

6. The developer apparatus of claim 1, wherein the top surfaces of the plurality of convex sections have apexes which project most toward the front side in the moving direction, and the apexes form the leading portions.

7. A developer apparatus, comprising:

a housing that stores toner inside;

a toner carrier roller that is shaped approximately like a cylinder, is mounted to the housing rotatably about a rotational axis, rotates while carrying toner on a surface thereof to convey the toner to outside the housing, and is provided, on the surface thereof, with a plurality of convex sections which are regularly arranged and a concave section which surrounds the convex sections, the convex sections including top surfaces that coincide with a part of a cylindrical surface of a single cylinder and have apexes which project most toward the front side in a moving direction of the surface of the toner carrier roller; and a seal member that is arranged in abutting contact with the surface of the toner carrier roller moving from the outside the housing toward the inside the housing to prevent toner leakage from the inside the housing, wherein each line that connects the apexes of two convex sections among adjacent convex sections whose positions are least different from each other in an axial direction, which is parallel to the rotational axis of the toner carrier roller, over a shortest distance along the cylindrical surface, partially forms a single helix on the cylindrical surface.

8. An image forming apparatus, comprising:

a latent image carrier that carries an electrostatic latent image;

a housing that stores toner inside;

a toner carrier roller that is shaped approximately like a cylinder, is mounted to the housing rotatably about a rotational axis, rotates while carrying toner on a surface thereof to convey the toner to an opposed position facing the latent image carrier, and is provided, on the surface thereof, with a plurality of convex sections which are regularly arranged and a concave section which surrounds the convex sections, the convex sections including top surfaces that coincide with a part of a cylindrical surface of a single cylinder; and a seal member that is arranged in abutting contact with the surface of the toner carrier roller moving from the outside the housing toward the inside the housing to prevent toner leakage from the inside the housing, wherein out of surrounding area of the top surface of each of the convex sections, a portion located at front-most in a moving direction associated with rotation of the toner carrier roller is a leading portion of the convex section, and a maximum value of gaps in an axial direction, which is parallel to the rotational axis of the toner carrier roller, between the trajectories which the leading portions of the convex sections follow while the toner carrier roller rotates one round is smaller than a volume average particle diameter of the toner.

* * * * *